US007631696B2

(12) United States Patent
Heller et al.

(10) Patent No.: US 7,631,696 B2
(45) Date of Patent: Dec. 15, 2009

(54) ZONE ISOLATION ASSEMBLY ARRAY FOR ISOLATING A PLURALITY OF FLUID ZONES IN A SUBSURFACE WELL

(75) Inventors: Noah R. Heller, Corte Madera, CA (US); Peter F. Moritzburke, Corte Madera, CA (US)

(73) Assignee: BESST, Inc., San Rafael, CA (US)

( * ) Notice: Subject to any disclaimer, the term of this patent is extended or adjusted under 35 U.S.C. 154(b) by 0 days.

(21) Appl. No.: 11/651,647

(22) Filed: Jan. 9, 2007

(65) Prior Publication Data

US 2007/0158065 A1 Jul. 12, 2007

Related U.S. Application Data

(60) Provisional application No. 60/758,030, filed on Jan. 11, 2006, provisional application No. 60/765,249, filed on Feb. 3, 2006.

(51) Int. Cl.
*E21B 43/00* (2006.01)

(52) U.S. Cl. ..... 166/313; 166/264; 166/386

(58) Field of Classification Search ..... 166/313, 166/373, 386, 264
See application file for complete search history.

(56) References Cited

U.S. PATENT DOCUMENTS 2,128,253 A 8/1938 Johnson (Continued)

OTHER PUBLICATIONS

U.S. Appl. No. 11/178,055, filed Jul. 8, 2005, entitled "Systems and Methods for Installation, Design and Operation of Groundwater Monitoring Systems in Boreholes".

(Continued)

*Primary Examiner*—Jennifer H Gay
*Assistant Examiner*—David Andrews
(74) *Attorney, Agent, or Firm*—Roeder & Broder LLP; James P. Broder

(57) ABSTRACT

A zone isolation assembly array (794) for a well (712) includes a first zone isolation assembly (722A) and a second zone isolation assembly (722B). The first zone isolation assembly (722A) selectively inhibits fluid communication between a first zone (726) and a second zone (728) of the well (712). The second zone isolation assembly (722B) can be positioned between the first zone isolation assembly (722A) and a surface region (32) of the well (712) in an in-line manner. The second zone isolation assembly (722B) selectively inhibits fluid communication between the second zone (728) and a third zone (796) of the well (712). In another embodiment, the zone isolation assembly array (794) includes a first docking receiver (748A), a second docking receiver (748B), a first docking apparatus (750A) and a second docking apparatus (750B). The docking receivers (748A, 748B) can be positioned in an in-line manner. The second docking apparatus (750B) is coupled to the first docking apparatus (750A). The zone isolation assembly array (794) can also a first fluid collector (752A) and a second fluid collector (752B). The first fluid collector (752A) collects a first fluid (738) from within the first zone (726) when the first docking apparatus (750A) is in the engaged position. The second fluid collector (752B) collects a second fluid (740) from within the second zone (728) when the second docking apparatus (750B) is in the engaged position. The first fluid collector (752A) can collect the first fluid (738) in a different manner than the second fluid collector (752B) collects the second fluid (740).

33 Claims, 11 Drawing Sheets

U.S. PATENT DOCUMENTS

| | | | | |
|---|---|---|---|---|
| 2,137,296 | A | | 11/1938 | Macready |
| 2,190,250 | A | | 2/1940 | Blackburn |
| 2,227,539 | A | | 1/1941 | Dorton |
| 2,776,013 | A | * | 1/1957 | Tausch ..... 166/150 |
| 2,946,387 | A | | 7/1960 | Hooker |
| 3,022,828 | A | * | 2/1962 | Hodges ..... 166/115 |
| 3,152,639 | A | | 10/1964 | Pearcy |
| 3,969,937 | A | | 7/1976 | Barrington et al. |
| 4,475,595 | A | | 10/1984 | Watkins et al. |
| 4,489,779 | A | | 12/1984 | Dickinson |
| 4,701,107 | A | | 10/1987 | Dickinson |
| 4,942,923 | A | | 7/1990 | Geeting |
| 4,995,456 | A | | 2/1991 | Cornette et al. |
| 5,293,931 | A | | 3/1994 | Nichols et al. |
| 5,293,934 | A | | 3/1994 | Burge et al. |
| 5,450,900 | A | | 9/1995 | Schalla et al. |
| 5,473,939 | A | | 12/1995 | Leder et al. |
| 5,687,791 | A | | 11/1997 | Beck et al. |
| 5,708,220 | A | | 1/1998 | Burge |
| 5,829,520 | A | | 11/1998 | Johnson |
| 5,909,773 | A | | 6/1999 | Koehler et al. |
| 6,158,516 | A | | 12/2000 | Smith et al. |
| 6,301,959 | B1 | | 10/2001 | Hrametz et al. |
| 6,508,310 | B1 | | 1/2003 | Mioduszewski et al. |
| 6,619,931 | B2 | | 9/2003 | Anderson |
| 6,668,943 | B1 | | 12/2003 | Maus et al. |
| 6,722,432 | B2 | | 4/2004 | Spiers et al. |
| 6,745,835 | B2 | | 6/2004 | Fields |
| 6,935,356 | B2 | | 8/2005 | Shepard et al. |
| 7,004,252 | B2 | | 2/2006 | Vise, Jr. |
| 7,111,682 | B2 | | 9/2006 | Blaisdell et al. |
| 7,320,364 | B2 | | 1/2008 | Fairbanks |
| 7,461,547 | B2 | | 12/2008 | Terabayashi et al. |
| 2002/0053438 | A1 | | 5/2002 | Williamson, Jr. |
| 2002/0166663 | A1 | | 11/2002 | Last et al. |
| 2003/0127227 | A1 | | 7/2003 | Fehr et al. |
| 2004/0050548 | A1 | | 3/2004 | Dybdahl |
| 2004/0134663 | A1 | | 7/2004 | Khomynets |
| 2005/0028974 | A1 | | 2/2005 | Moody |
| 2005/0051329 | A1 | | 3/2005 | Blaisdell |
| 2005/0224229 | A1 | | 10/2005 | Blacklaw |
| 2007/0199691 | A1 | | 8/2007 | Heller et al. |

OTHER PUBLICATIONS

San Diego Plastics, Inc., http://www.sdplastics.com/pvc.html, Jan. 21, 1997. Web Page is unavailable.

International Search Report, PCT/US0700701 (relevant page).

* cited by examiner

ZONE ISOLATION ASSEMBLY ARRAY FOR ISOLATING A PLURALITY OF FLUID ZONES IN A SUBSURFACE WELL

RELATED APPLICATIONS

This Application claims the benefit on U.S. Provisional Application Ser. No. 60/758,030 filed on Jan. 11, 2006, and on U.S. Provisional Application Ser. No. 60/765,249 filed on Feb. 3, 2006. The contents of U.S. Provisional Application Ser. Nos. 60/758,030 and 60/765,249 are incorporated herein by reference.

BACKGROUND

Subsurface wells for extracting and/or testing fluid (liquid or gas) samples on land and at sea have been used for many years. Many structures have been developed in an attempt to isolate the fluid from a particular depth in a well so that more accurate in situ or remote laboratory testing of the fluid at that depth "below ground surface" (bgs) can be performed. Unfortunately, attempts to accurately and cost-effectively accomplish this objective have been not altogether satisfactory.

For example, typical wells include riser pipes have relatively large diameters, i.e. 2-4 inches, or greater. Many such wells can have depths that extend hundreds or even thousands of feet bgs. In order to accurately remove a fluid sample from a particular target zone within a well, such as a sample at 1,000 feet bgs, typical wells require that the fluid above the target zone be removed at least once, and more commonly 3 to 5 times this volume, in order to obtain a more representative fluid sample from the desired level. From a volumetric standpoint, traditional wet casing volumes of 2-inch and 4-inch monitoring wells are 0.63 liters (630 ml) to 2.5 liters (2,500 ml) per foot, respectively. As an example, to obtain a sample at 1,000 feet bgs, approximately 630 liters to 2,500 liters of fluid must be purged from the well at least once and more commonly as many as 3 to 5 times this volume. The time required and costs associated with extracting this fluid from the well can be rather significant.

One method of purging fluid from the well and/or obtaining a fluid sample includes using coaxial gas displacement within the riser pipe of the well. Unfortunately, this method can have several drawbacks. First, gas consumption during pressurization of these types of systems can be relatively substantial because of the relatively large diameter and length of riser pipe that must be pressurized. Second, introducing large volumes of gas into the riser pipe can potentially have adverse effects on the volatile organic compounds (VOC's) being measured in the fluid sample that is not collected properly. Third, a pressure sensor that may be present within the riser pipe of a typical well is subjected to repeated pressure changes from the coaxial gas displacement pressurization of the riser pipe. Over time, this artificially-created range of pressures in the riser pipe may have a negative impact on the accuracy of the pressure measurements from the sensor. Fourth, residual gas pressure can potentially damage one or more sensors and/or alter readings from the sensors once substantially all of the fluid has passed through the sample collection line past the sensors. Fifth, any leaks in the system can cause gas to be forcibly infused into the ground formation, which can influence the results of future sample collections.

Another method for purging fluid from these types of wells includes the use of a bladder pump. Bladder pumps include a bladder that alternatingly fills and empties with a gas to force movement of the fluid within a pump system. However, the bladders inside these pumps can be susceptible to leakage due to becoming fatigued or detached during pressurization. Further, the initial cost as well as maintenance and repair of bladder pumps can be relatively expensive. In addition, at certain depths, bladder pumps require an equilibration period during pressurization to decrease the likelihood of damage to or failure of the pump system. This equilibration period can result in a slower overall purging process, which decreases efficiency.

An additional method for purging fluid from a well includes using an electric submersible pump system having an electric motor. This type of system can be susceptible to electrical shorts and/or burning out of the electric motor. Additionally, this type of pump typically uses one or more impellers that can cause pressure differentials (e.g., drops), which can result in VOC loss from the sample being collected. Operation of these types of electric pumps can also raise the temperature of the groundwater, which can also impact VOC loss. Moreover, these pumps can be relatively costly and somewhat more difficult to repair and maintain.

Further, the means for physically isolating a particular zone of the well from the rest of the well can have several shortcomings. For instance, inflatable packers are commonly used to isolate the fluid from a particular zone either above or below the packer. However, these types of packers can be subject to leakage, and can be cumbersome and relatively expensive. In addition, these packers are susceptible to rupturing, which potentially damage the well.

SUMMARY

The present invention is directed toward a zone isolation assembly array for a subsurface well. The subsurface well has a surface region, a first zone, a second zone and a third zone. Each zone is positioned at a different depth from one another within the subsurface well relative to the surface region. In one embodiment, the zone isolation assembly array includes a first zone isolation assembly and a second zone isolation assembly. The first zone isolation assembly moves between a disengaged position that allows fluid communication between the first zone and the second zone and an engaged position that inhibits fluid communication between the first zone and the second zone. The second zone isolation assembly is positioned between the first zone isolation assembly and the surface region. The second zone isolation assembly moves between a disengaged position that allows fluid communication between the second zone and the third zone and an engaged position that inhibits fluid communication between the second zone and the third zone.

In one embodiment, the first zone isolation assembly and the second isolation assembly are dissimilar from one another. For example, the first zone isolation assembly and the second isolation assembly can have a different configuration from one another. In certain embodiments, the first zone isolation assembly and the second zone isolation assembly each necessarily move from the disengaged position to the engaged position in a synchronized manner. Alternatively, the first zone isolation assembly and the second zone isolation assembly can each necessarily move between the disengaged position and the engaged position at different times. Further, the first zone isolation assembly and the second isolation assembly can be positioned in an in-line manner within the subsurface well.

In another embodiment, the zone isolation assembly array includes a first docking receiver, a second docking receiver, a first docking apparatus and a second docking apparatus. The first docking receiver is fixed within the subsurface well. The second docking receiver is fixed within the subsurface well and is more proximate the surface region than the first docking receiver. The first docking apparatus is adapted to be moved from the surface region to an engaged position with the first docking receiver to inhibit fluid communication between the first zone and the second zone. The second docking apparatus is coupled to the first docking apparatus. The second docking apparatus is adapted to be moved from the surface region to an engaged position with the second docking receiver to inhibit fluid communication between the second zone and the third zone.

In certain embodiments, the second docking receiver has a second lower receiver opening. The first docking apparatus is adapted to move through the second lower receiver opening during movement of the first docking apparatus from the surface region to the engaged position. The zone isolation assembly array can also a first fluid collector that is coupled to the first docking apparatus. The first fluid collector is adapted to collect a first fluid from within the first zone when the first docking apparatus is in the engaged position. The zone isolation assembly array can also include a second fluid collector that is coupled to the second docking apparatus. The second fluid collector is adapted to collect a second fluid from within the second zone when the second docking apparatus is in the engaged position. In some embodiments, the first fluid collector collects the first fluid in a different manner than the second fluid collector collects the second fluid.

The present invention is also directed toward a method for isolating a plurality of zones within a subsurface well.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
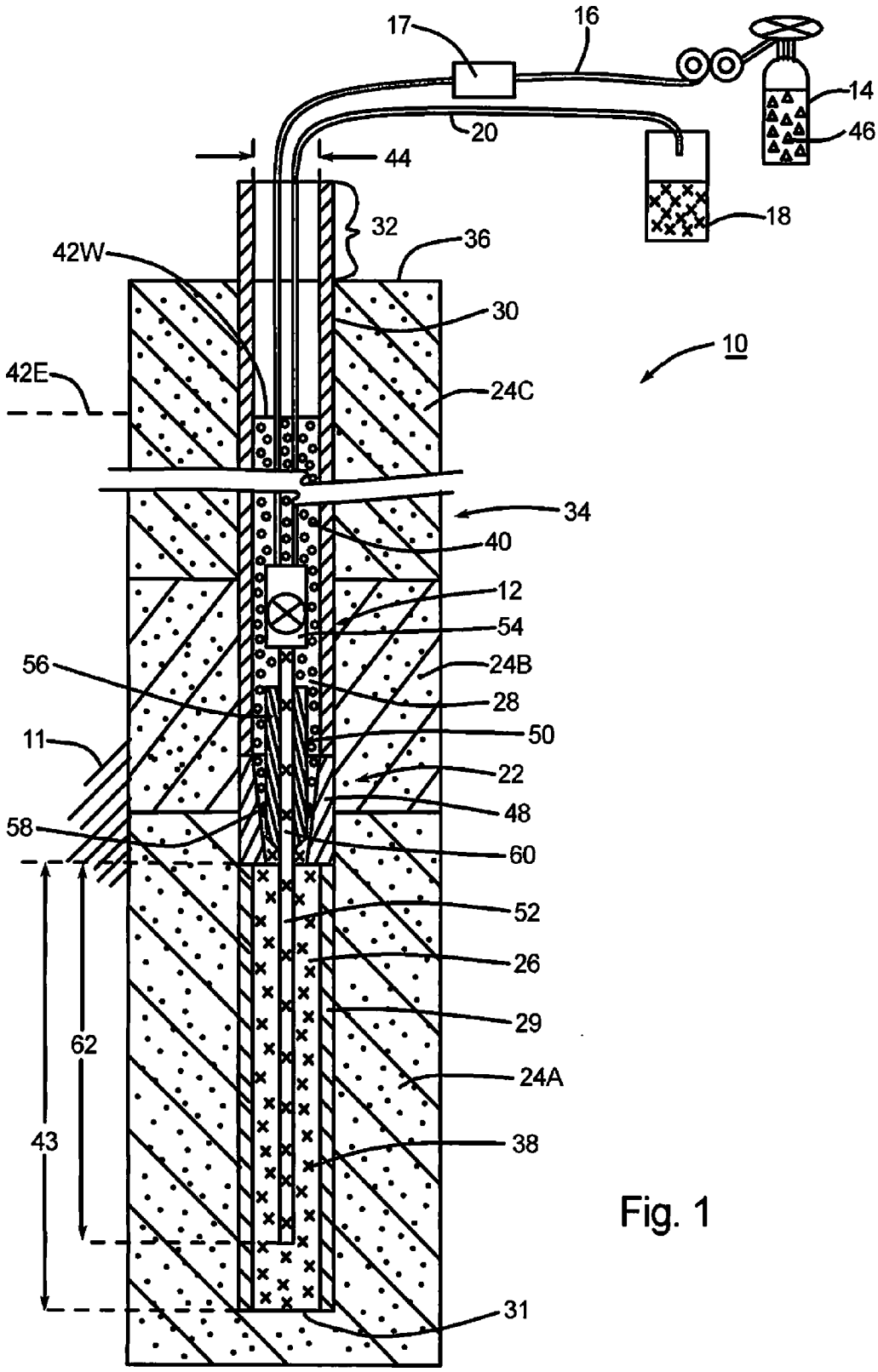
FIG. 1 is a schematic view of one embodiment of a fluid monitoring system having features of the present invention, including one embodiment of a zone isolation assembly.

FIG. 1 is a schematic view of one embodiment of a fluid monitoring system 10 for monitoring one or more parameters of subsurface fluid from an adjacent environment 11. As used herein, the term "environment" can include naturally occurring or artificial (manmade) environments 11 of either solid or liquid materials. As non-exclusive examples, the environment 11 can include a ground formation of soil, rock or any other types of solid formations, or the environment 11 can include a portion of a body of water (ocean, lake, river, etc.) or other liquid regions.

Monitoring the fluid in accordance with the present invention can be performed in situ or following removal of the fluid from its native or manmade environment 11. As used herein, the term "monitoring" can include a one-time measurement of a single parameter of the fluid, multiple or ongoing measurements of a single parameter of the fluid, a one-time measurement of multiple parameters of the fluid, or multiple or ongoing measurements of multiple parameters of the fluid. Further, it is recognized that subsurface fluid can be in the form of a liquid and/or a gas. In addition, the Figures provided herein are not to scale given the extreme heights of the fluid monitoring systems relative to their widths.

The fluid monitoring system 10 illustrated in FIG. 1 can include a subsurface well 12, a gas source 14, a gas inlet line 16, a controller 17, a fluid receiver 18, a fluid outlet line 20 and a zone isolation assembly 22. In this embodiment, the subsurface well 12 (also sometimes referred to herein simply as "well") includes one or more layers of annular materials 24A, 24B, 24C, a first zone 26, a second zone 28, a fluid inlet structure 29, and a riser pipe 30. It is understood that although the fluid monitoring systems 10 described herein are particularly suited to be installed in the ground, various embodiments of the fluid monitoring systems 10 are equally suitable for installation and use in a body of water, or in a combination of both ground and water, and that no limitations are intended in any manner in this regard.

The subsurface well 12 can be installed using any one of a number of methods known to those skilled in the art. In non-exclusive, alternative examples, the well 12 can be installed with hollow stem auger, sonic, air rotary casing hammer, dual wall percussion, dual tube, rotary drilling, vibratory direct push, cone penetrometer, cryogenic, ultrasonic and/or laser methods, or any other suitable method known to those skilled in the art of drilling and/or well placement. The wells 12 described herein include a surface region 32 and a subsurface region 34. The surface region 32 is an area that includes the top of the well 12 which extends to a surface 36. Stated another way, the surface region 32 includes the portion of the well 12 that extends between the surface 36 and the top of the riser pipe 30, whether the top of the riser pipe 30 is positioned above or below the surface 36. The surface 36 can either be a ground surface or the surface of a body of water or other liquid, as non-exclusive examples. The subsurface region 34 is the portion of the well 12 that is below the surface region 32, e.g., at a greater depth than the surface region 34.

The annular materials 24A-C can include a first layer 24A (illustrated by dots) that is positioned at or near the first zone 26, and a second layer 24B (illustrated by dashes) that is positioned at or near the second zone 28. The annular materials are typically positioned in layers 24A-C during installation of the well 12. It is recognized that although three layers 24A-C are included in the embodiment illustrated in FIG. 1, greater or fewer than three layers 24A-C of annular materials can be used in a given well 12.

In one embodiment, for example, the first layer 24A can be sand or any other suitably permeable material that allows fluid to move from the surrounding ground environment 11 to the fluid inlet structure 29 of the well 12. The second layer 24B is positioned above the first layer 24A. The second layer 24B can be formed from a relatively impermeable layer that inhibits migration of fluid from the environment 11 near the fluid inlet structure 29 and the first zone 26 to the riser pipe 30 and the second zone 28. For example, the second layer 24B can include a bentonite material or any other suitable material of relative impermeability. In this embodiment, the second layer 28 helps increase the likelihood that the fluid collected through the fluid inlet structure 29 of the well 12 is more representative of the fluid from the environment 11 adjacent to the fluid inlet structure 29. The third layer 24C is positioned above the second layer 24B and can be formed from any suitable material, such as backfilled grout, bentonite, volclay and/or native soil, as one non-exclusive example. The third layer 24C is positioned away from the first layer 24A to the extent that the likelihood of fluid migrating from the environment 11 near the third layer 24C down to the fluid inlet structure 29 is reduced or prevented.

As used herein, the first zone 26 is a target zone from which a particular fluid sample is desired to be taken and/or monitored. Further, the second zone 28 can include fluid that is desired to be excluded from the fluid sample to be removed from the well 12 and/or tested, and is adjacent to the first zone 26. In the embodiments provided herein, the first zone 26 is positioned either directly beneath or at an angle below the second zone 28 such that the first zone 26 is further from the surface 36 of the surface region 32 than the second zone 28.

In each well 12, the first zone 26 has a first volume and the second zone 28 has a second volume. In certain embodiments, the second volume is substantially greater than the first volume because the height of the second zone 28 can be substantially greater than a height of the first zone 26. For example, the height of the first zone 26 can be on the order of between several inches to five or ten feet. In contrast, the height of the second zone 28 can be from several feet up to several hundreds or thousands of feet. Assuming somewhat similar inner dimensions of the first zone 26 and the second zone 28, the second volume can be from 100% to 100,000% greater than the first volume. As one non-exclusive example, in a 1-inch inner diameter well 12 having a depth of 1,000 feet, with the first zone 26 positioned at the bottom of the well 12, the first zone having a height of approximately five feet, the second zone 28 would have a height of approximately 995 feet. Thus, the first volume would be approximately 47 $in^3$, while the second volume would be approximately 9.378 $in^3$, or approximately 19,800% greater than the first volume.

For ease in understanding, the first zone 26 includes a first fluid 38 (illustrated with X's), and the second zone 28 includes a second fluid 40 (illustrated with O's). The first fluid 38 and the second fluid 40 migrate as a single fluid to the well 12 through the environment 11 outside of the fluid inlet structure 29. In this embodiment, a well fluid level 42W in the well 12 is the top of the second fluid 40, which, at equilibrium, is approximately equal to an environmental fluid level 42E in the environment 11, although it is acknowledged that some differences between the well fluid level 42W and the environmental fluid level 42E can occur. During equilibration of the fluid levels 42W, 42E, the fluid rises in the first zone 26 and the second zone 28 of the well 12. Due to gravitational forces and/or other influences, the fluid near an upper portion (e.g., in the second zone 28) of the well 12 will have a different composition from the fluid near a lower portion (e.g., in the first zone 26) of the well 12. Thus, although the first fluid 38 and the second fluid 40 can originate from a somewhat similar location within the environment 11, the first fluid 38 and the second fluid 40 can ultimately have different compositions at a point in time after entering the well 12, based on the relative positions of the fluids 38, 40 within the well 12.

The first fluid 38 is the liquid or gas that is desired for monitoring and/or testing. In this and other embodiments, it is desirable to inhibit mixing or otherwise commingling of the first fluid 38 and the second fluid 40 before monitoring and/or testing the first fluid 38. As described in greater detail below, the first fluid 38 and the second fluid 40 can be effectively isolated from one another utilizing the zone isolation assembly 22.

The fluid inlet structure 29 allows fluid from the first layer 24A outside the first zone 26 to migrate into the first zone 26. The design of the fluid inlet structure 29 can vary. For example, the fluid inlet structure 29 can have a substantially tubular configuration or another suitable geometry. Further, the fluid inlet structure 29 can be perforated, slotted, screened or can have some other alternative openings or pores (not shown) that allow fluid and/or various particulates to enter into the first zone 26. The fluid inlet structure 29 can include an end cap 31 at the lowermost end of the fluid inlet structure 29 that inhibits material from the first layer 24A from entering the first zone 26.

The fluid inlet structure 29 has a length 43 that can vary depending upon the design requirements of the well 12 and the subsurface monitoring system 10. For example, the length 43 of the fluid inlet structure 29 can be from a few inches to several feet or more.

The riser pipe 30 is a hollow, cylindrically-shaped structure. The riser pipe 30 can be formed from any suitable materials. In one non-exclusive embodiment, the riser pipe 30 can be formed from a polyvinylchloride (PVC) material and can be any desired thickness, such as Schedule 80, Schedule 40, etc. Alternatively, the riser pipe 30 can be formed from other plastics, fiberglass, ceramic, metal, etc. The length (oriented substantially vertically in FIG. 1) of the riser pipe 30 can vary depending upon the requirements of the system 10. For example, the length of the riser pipe 30 can be within the range of a few feet to thousands of feet, as necessary. It is recognized that although the riser pipe 30 illustrated in the Figures is illustrated substantially vertically, the riser pipe 30 and other structures of the well 12 can be positioned at any suitable angle from vertical.

The inner diameter 44 of the riser pipe 30 can vary depending upon the design requirements of the well 12 and the fluid monitoring system 10. In one embodiment, the inner diameter 44 of the riser pipe 30 is less than approximately 2.0 inches. For example, the inner diameter 44 of the riser pipe 30 can be approximately 1.85 inches. In non-exclusive alternative embodiments, the inner diameter 44 of the riser pipe 30 can be approximately 1.40 inches, 0.90 inches, 0.68 inches, or any other suitable dimension. In still other embodiments, the inner diameter 44 of the riser pipe 30 can be greater than 2.0 inches.

The gas source 14 includes a gas 46 (illustrated with small triangles) that is used to move the first fluid 38 as provided in greater detail below. The gas 46 used can vary. For example, the gas 46 can include nitrogen, argon, oxygen, helium, air, hydrogen, or any other suitable gas. In one embodiment, the flow of the gas 46 can be regulated by the controller 17, which can be manually or automatically operated and controlled, as needed.

The gas inlet line 16 is a substantially tubular line that directs the gas 46 to the well 12 or to various structures and/or locations within the well 12, as described in greater detail below.

The controller 17 can control or regulate various processes related to fluid monitoring. For example, the controller 17 can adjust and/or control timing of the gas delivery to various structures within the well 12. Additionally, or alternatively, the controller 17 can adjust and/or regulate the volume of gas 46 that is delivered to the various structures within the well 12. In one embodiment, the controller 17 can include a computerized system. It is recognized that the positioning of the controller 17 within the fluid monitoring system 10 can be varied depending upon the specific processes being controlled by the controller 17. In other words, the positioning of the controller 17 illustrated in FIG. 1 is not intended to be limiting in any manner.

The fluid receiver 18 receives the first fluid 38 from the first zone 26 of the well 12. Once received, the first fluid 38 can be monitored and/or tested by methods known by those skilled in the art. Alternatively, the first fluid 38 can be monitored and/or tested prior to being received by the fluid receiver 18. The first fluid 38 is transferred to the fluid receiver 18 via the fluid outlet line 20. Alternatively, the fluid receiver 18 can receive a different fluid from another portion of the well 12.

The zone isolation assembly 22 selectively isolates the first fluid 38 in the first zone 26 from the second fluid 40 in the second zone 28. The design of the zone isolation assembly 22 can vary to suit the design requirements of the well 12 and the fluid monitoring system 10. In the embodiment illustrated in FIG. 1, the zone isolation assembly 22 includes a docking receiver 48, a docking apparatus 50, a fluid collector 52 and a pump assembly 54.

In the embodiment illustrated in FIG. 1, the docking receiver 48 is fixedly secured to the fluid inlet structure 29 and the riser pipe 30. In various embodiments, the docking receiver 48 is positioned between and threadedly secured to the fluid inlet structure 29 and the riser pipe 30. In non-exclusive alternative embodiments, the docking receiver 48 can be secured to the fluid inlet structure 29 and/or the riser pipe 30 in other suitable ways, such as by an adhesive material, welding, fasteners, or by integrally forming or molding the docking receiver 48 with one or both of the fluid inlet structure 29 and at least a portion of the riser pipe 30. Stated another way, the docking receiver 48 can be formed unitarily with the fluid inlet structure 29 and/or at least a portion of the riser pipe 30.

In certain embodiments, the docking receiver 48 is at least partially positioned at the uppermost portion of the first zone 26. In other words, a portion of the first zone 26 is at least partially bounded by the docking receiver 48. Further, the docking receiver 48 can also be positioned at the lowermost portion of the second zone 28. In this embodiment, a portion of the second zone 28 is at least partially bounded by the docking receiver 48.

The docking apparatus 50 selectively docks with the docking receiver 48 to form a substantially fluid-tight seal between the docking apparatus 50 and the docking receiver 48. The design and configuration of the docking apparatus 50 as provided herein can be varied to suit the design requirements of the docking receiver 48. In various embodiments, the docking apparatus 50 moves from a disengaged position wherein the docking apparatus 50 is not docked with the docking receiver 48, to an engaged position wherein the docking apparatus 50 is docked with the docking receiver 48.

In the disengaged position, the first fluid 38 and the second fluid 40 are not isolated from one another. In other words, the first zone 26 and the second zone 28 are in fluid communication with one another. In the engaged position (illustrated in FIG. 1), the first fluid 38 and the second fluid 40 are isolated from one another. Stated another way, in the engaged position, the first zone 26 and the second zone 28 are not in fluid communication with one another. It should be understood that as used herein, the terminology of the docking apparatus 50 being in a disengaged position or an engaged position can be equally applied to one or more zone isolation assemblies 22 likewise being in a disengaged or an engaged position.

The docking apparatus 50 includes a docking weight 56, a resilient seal 58 and a fluid channel 60. In various embodiments, the docking weight 56 has a specific gravity that is greater than water. In non-exclusive alternative embodiments, the docking weight 56 can be formed from materials so that the docking apparatus has an overall specific gravity that is at least approximately 1.50, 2.00, 2.50, 3.00, or 4.00. In certain embodiments, the docking weight 56 can be formed from materials such as metal, ceramic, epoxy resin, rubber, nylon, Teflon, Nitrile, Viton, glass, plastic or other suitable materials having the desired specific gravity characteristics.

In various embodiments, the resilient seal 58 is positioned around a circumference of the docking weight 56. The resilient seal 58 can be formed from any resilient material such as rubber, urethane or other plastics, certain epoxies, or any other material that can form a substantially fluid-tight seal with the docking receiver 48. In one non-exclusive embodiment, for example, the resilient seal 58 is a rubberized O-ring. In this embodiment, because the resilient seal 58 is in the form of an O-ring, a relatively small surface area of contact between the resilient seal 58 and the docking receiver 48 occurs. As a result, a higher force in pounds per square inch (psi) is achieved. For example, a fluid-tight seal between the docking receiver 48 and the resilient seal 58 can be achieved with a force that is less than approximately 1.00 psi. In non-exclusive alternative embodiments, the force can be less than approximately 0.75, 0.50, 0.40 or 0.33 psi. Alternatively, the force can be greater than 1.00 psi or less than 0.33 psi.

The fluid channel 60 can be a channel or other type of conduit for the first fluid 38 to move through the docking weight 56, in a direction from the fluid collector 52 toward the pump assembly 54. In one embodiment, the fluid channel 60 can be tubular and can have a substantially circular cross-section. Alternatively, the fluid channel 60 can have another suitable configuration. The positioning of the fluid channel 60 within the docking weight 56 can vary. In one embodiment, the fluid channel 60 can be generally centrally positioned within the docking weight 56 so that the first fluid 38 flows substantially centrally through the docking weight 56. Alternatively, the fluid channel 60 can be positioned in an off-center manner. In certain embodiments, the fluid channel 60 effectively extends from the docking weight 56 to the pump assembly 54.

The docking apparatus 50 can be lowered into the well 12 from the surface region 32. In certain embodiments, the docking apparatus 50 utilizes the force of gravity to move down the riser pipe 30, through any fluid present in the riser pipe 30 and into the engaged position with the docking receiver 48. Alternatively, the docking apparatus 50 can be forced down the riser pipe 30 and into the engaged position by another suitable means.

The docking apparatus 50 is moved from the engaged position to the disengaged position by exerting a force on the docking apparatus 50 against the force of gravity, such as by pulling in a substantially upward manner, e.g., in a direction from the docking receiver 48 toward the surface region 32, on a tether or other suitable line coupled to the docking apparatus 50 to break or otherwise disrupt the seal between the resilient seal 58 and the docking receiver 48.

The fluid collector 52 collects the first fluid 38 from the first zone 26 for transport of the first fluid 38 toward the surface region 32. The design of the fluid collector 52 can vary depending upon the requirements of the subsurface monitoring system 10. In the embodiment illustrated in FIG. 1, the fluid collector 52 is secured to the docking apparatus 50 and extends in a downwardly direction into the first zone 26 when the docking apparatus is in the engaged position. In the embodiment illustrated in FIG. 1, the fluid collector 52 is a perforated sipping tube that receives the first fluid 38 from the first zone 26. As provided previously, when the docking apparatus 50 is in the engaged position with the docking receiver 48, the first zone 26 is isolated from the second zone 28. Thus, because the fluid collector 52 is positioned within the first zone 26, in the engaged position, the fluid collector 52 only collects the first fluid 38.

The fluid collector 52 has a length 62 that can be varied to suit the design requirements of the first zone 26 and the fluid monitoring system 10. In certain embodiments, the fluid collector 52 extends substantially the entire length 43 of the fluid inlet structure 29. Alternatively, the length 62 of the fluid collector 52 can be any suitable percentage of the length 43 of the fluid inlet structure 29.

The pump assembly 54 pumps the first fluid 38 that enters the pump assembly 54 to the fluid receiver 18 via the fluid outlet line 20. The design and positioning of the pump assembly 54 can vary. In one embodiment, the pump assembly 54 is a highly robust, miniaturized low flow pump that can easily fit into a relatively small diameter wells 12, such as a 1-inch or ¾-inch riser pipe 30, although the pump assembly 54 is also adaptable to be used in larger diameter wells 12.

In the embodiment illustrated in FIG. 1, the pump assembly 54 can include one or more one-way valves (not shown in FIG. 1) such as those found in a single valve parallel gas displacement pump, double valve pump, bladder pump, electric submersible pump and/or other suitable pumps, that are utilized during pumping of the first fluid 38 to the fluid receiver 18. The one way valve(s) allow the first fluid 38 to move from the first zone 26 toward the fluid outlet line 20, without the first fluid 38 moving in the opposite direction. These types of one-way valves can include poppet valves, reed valves, electronic valves, electromagnetic valves and/or check valves, for example. The gas inlet line 16 extends to the pump assembly 54, and the fluid outlet line 20 extends from the pump assembly 54. In this embodiment, because the environmental fluid level 42E is above the level of the fluid collector 52, the level of the first fluid 38 equilibrates at a somewhat similar level within the fluid outlet line 20 (as well as the gas inlet line 16) as the environmental fluid level 42E, until such time as the first fluid 38 is pumped or otherwise transported toward the surface region 32.

As explained in greater detail below, gas 46 from the gas source 14 is delivered down the gas inlet line 16 to the pump assembly 54 to force the first fluid 38 that has migrated to the pump assembly 54 during equilibration upward through the fluid outlet line 20 to the fluid receiver 18. With this design, the gas 46 does not cause any pressurization of the riser pipe 30, nor does the gas 46 utilize the riser pipe 30 during the pumping process. Stated another way, in this and other embodiments, the riser pipe 30 does not form any portion of the pump assembly 54. With this design, the need for high-pressure riser pipe 30 is reduced or eliminated. Further, gas consumption is greatly reduced because the riser pipe 30, which has a relatively large volume, need not be pressurized.

The pump assembly 54 can be coupled to the docking apparatus 50 so that removal of the docking apparatus 50 from the well 12 likewise results in simultaneous removal of the pump assembly 54 (and the fluid collector 52) from the well 12.

In an alternative embodiment, the pump assembly 54 can be incorporated as part of the docking apparatus 50 within a single structure. In this embodiment, the docking apparatus 50 can house the pump assembly 54, thereby obviating the need for two separate structures (docking apparatus 50 and pump assembly 54) that are illustrated in FIG. 1. Instead, in this embodiment, only one structure would be used which would serve the purposes described herein for the docking apparatus 50 and the pump assembly 54.

In operation, following installation of the well 12, fluid from the environment enters the first zone 26 through the fluid inlet structure 29. Before the docking apparatus 50 is in the engaged position, the first zone 26 and the second zone 28 are in fluid communication with one another, thereby allowing the fluid to flow upwards and mix into the second zone while the fluid level is equilibrating within the well 12.

During a monitoring, sampling or testing process, the docking apparatus 50 is lowered into the well 12 down the riser pipe 30 until the docking apparatus 50 engages with the docking receiver 48. The resilient seal 58 forms a fluid-tight seal with the docking receiver 48 so that the first zone 26 and the second zone 28 are no longer in fluid communication with one another. At this point the fluid within the well becomes separated into the first fluid 38 and the second fluid 40.

In the embodiment illustrated in FIG. 1, the fluid collector 52 begins collecting the first fluid 38, resulting in a raising of the first fluid 38 upwards from the fluid collector 52 toward the pump assembly 54, depending upon the environmental fluid level 42E. The first fluid 38 remains isolated from the second fluid 40 during this process since the pump assembly 54 is self-contained and does not rely on the riser pipe 30 as part of the structure of the pump assembly 54 in any way.

The controller 17 (or an operator of the system) can commence the flow of gas 46 to the pump assembly 54 to begin pumping the first fluid 38 through the fluid outlet line 20 to the fluid receiver 18, as described in greater detail below. Once the first fluid 38 has been substantially purged from the first zone 26, the controller 17 can stop the flow of gas 46, which effectively stops the pumping process. The first zone 26 can then refill with more fluid from the environment 11, which can then be monitored, analyzed and/or removed for further testing as needed. Alternatively, the process of purging the fluid can be immediately followed by sampling the fluid 38, with the controller 17 being in continuous operation.

Because the volume of the first zone 26 is relatively small in comparison with the volume of the second zone 28, purging of the first fluid 38 from the first zone 26 occurs relatively rapidly. Further, because the first zone 26 is the sampling zone from which the first fluid 38 is collected, there is no need to purge or otherwise remove any of the second fluid 40 from the second zone 28. As long as the docking apparatus 50 remains in the engaged position, any fluid entering the first zone 26 will not be substantially influenced by or diluted with the second fluid 40.

Figure 2:
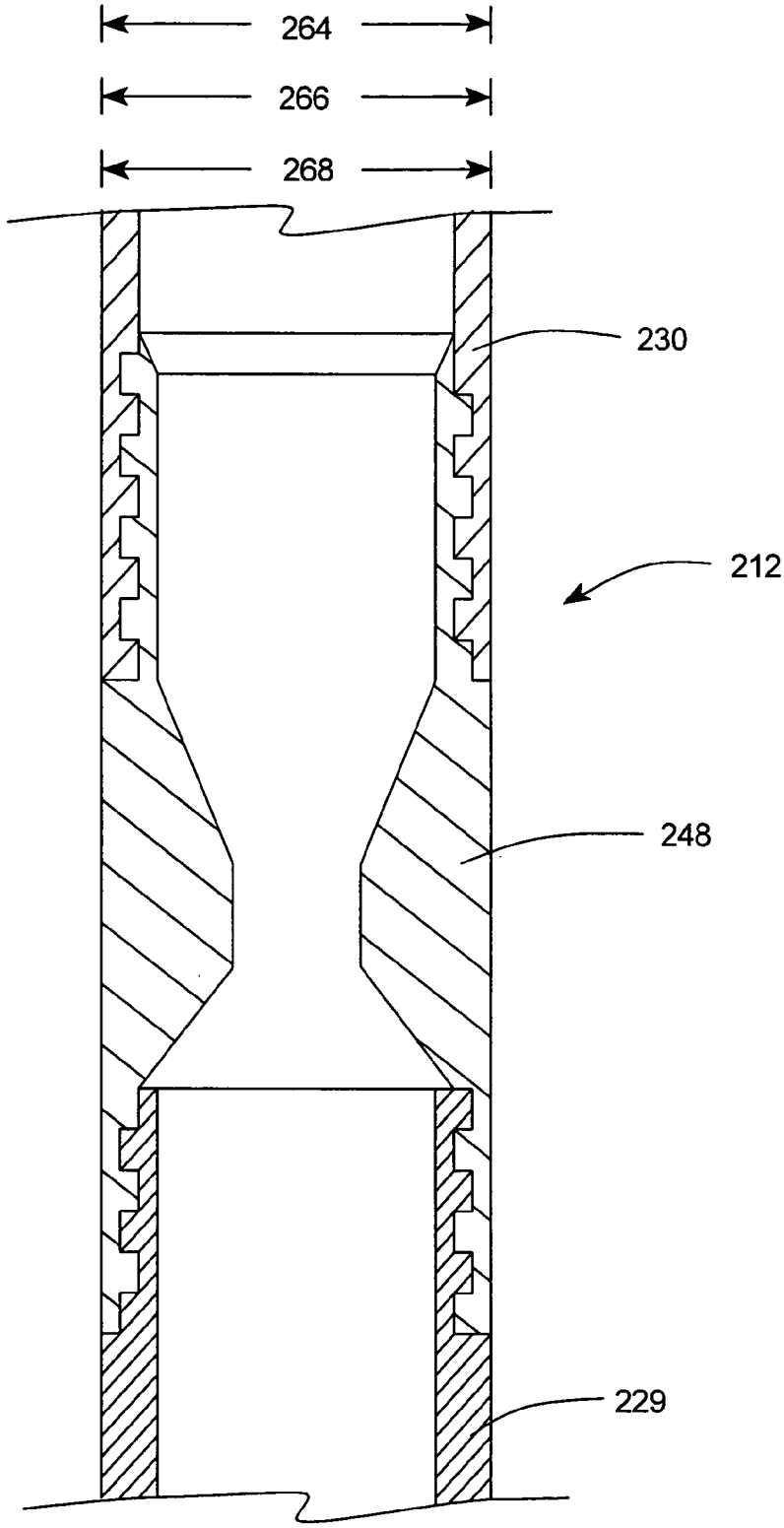
FIG. 2 is a cross-sectional view of a portion of one embodiment of a portion of the subsurface well, including a portion of a fluid inlet structure, a portion of a riser pipe and a docking receiver.

FIG. 2 is a detailed cross-sectional view of one embodiment of a portion of the subsurface well 212, including a portion of the fluid inlet structure 229, a portion of the riser pipe 230 and the docking receiver 248. In this embodiment, the docking receiver 248 is threadedly secured to the fluid inlet structure 229. Further, the riser pipe 230 is threadedly secured to the docking receiver 248. The docking receiver 248 is positioned between the fluid inlet structure 229 and the riser pipe 230. In alternative embodiments, the fluid inlet structure 229, the riser pipe 230 and/or the docking receiver 248 can be secured to one another by a different mechanism, such as by an adhesive material, welding, or any other suitable means. Still alternatively, the fluid inlet structure 229, the riser pipe 230 and/or the docking receiver 248 can be formed or molded as a unitary structure, which may or may not be homogeneous.

The fluid inlet structure 229 has an outer diameter 264, the riser pipe 230 has an outer diameter 266, and the docking receiver 248 has an outer diameter 268. In this embodiment, the outer diameters 264, 266, 268 are substantially similar so that the outer casing of the well 212 has a standard form factor and is relatively uniform for easier installation. Alternatively, the outer diameters 264, 266, 268 can be different from one another.

Figure 3A:
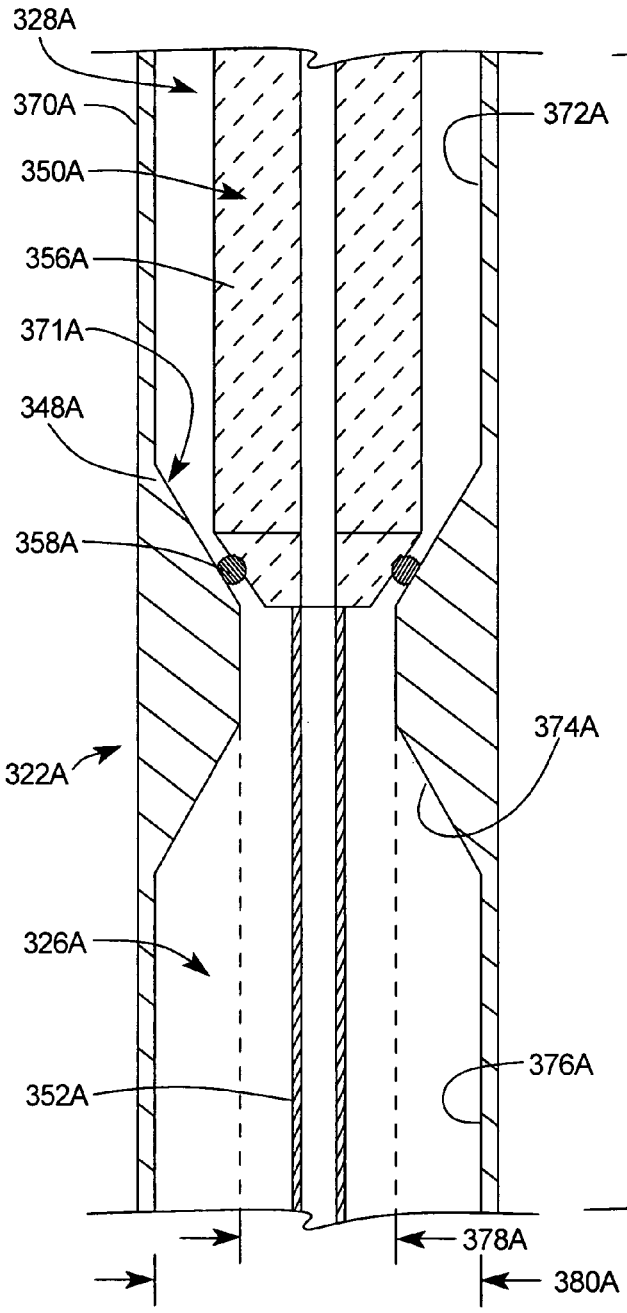
FIG. 3A is a cross-sectional view of a portion of an embodiment of the zone isolation assembly including a docking apparatus shown in an engaged position with a first embodiment of the docking receiver.

FIG. 3A is a cross-sectional view of a portion of an embodiment of the zone isolation assembly 322A including a docking apparatus 350A shown in the engaged position with a first embodiment of the docking receiver 348A. In this embodiment, the docking apparatus 350A includes the docking weight 356A and the resilient seal 358A. The force of gravity causes the docking weight 356A to impart a substantially downward force on the resilient seal 358A, which in turn, imparts a substantially downward force on the docking receiver 348A.

In one embodiment, the resilient seal 358A can be an O-ring. For example, the O-ring can be formed from a compressible material such as rubber, Viton, Nitrile, Teflon, plastic, epoxy, or any other suitable material that is compatible with the docking receiver 348A for forming a fluid-tight seal to maintain fluid isolation between the first zone 326A and the second zone 328A. Alternatively, the resilient seal 358A can have another suitable configuration that is different than an O-ring.

Because of the relatively small surface area of the O-ring or other similar resilient seal 358A that is in contact with the docking receiver 348A when the docking apparatus 350A is in the engaged position, and the relatively high specific gravity of the docking weight 356A, a higher force in terms of pounds per square inch (psi) is achieved between the resilient seal 358A and the docking receiver 348A. As a result, the likelihood of achieving a fluid-tight seal is increased or achieved, and the likelihood of fluid leakage between the docking receiver 348A and the docking apparatus 350A is reduced or eliminated. Additionally, because of the relatively high force between the resilient seal 358A and the docking receiver 348A, in various embodiments, the resilient seal 358A is not inflatable. In these embodiments, the force of gravity is substantial enough to maintain the required fluid-tight seal and maintain the docking apparatus 350A in the engaged position.

Further, in the embodiment illustrated in FIG. 3A, the docking receiver 348A has an exterior surface 370A and an interior surface 371A having a substantially linear upper section 372A, an hourglass-shaped intermediate section 374A and a substantially linear lower section 376A. In one embodiment, the upper section 372A and the lower section 376A of the interior surface 371A are substantially parallel with the exterior surface 370A. With this design, the docking apparatus 350A move easily upward or downward in the upper section 372A, and can firmly seat onto the intermediate section 374A of the docking receiver 348A when engaging with the docking receiver 348A.

The intermediate section 374A has an inner diameter 378A near the location of contact between the resilient seal 358A and the docking receiver 348A that is smaller than an inner diameter 380A of the lower section 376A. Stated another way, the inner diameter 378A of the intermediate section 374A increases moving in a direction from the point of contact between the resilient seal 358A toward the lower section 376A. With this design, the first zone 326A can hold a greater volume of the first fluid 38 (illustrated in FIG. 1). In addition, a greater spacing between the fluid collector 352A and the docking receiver 348A can be achieved.

Figure 3B:
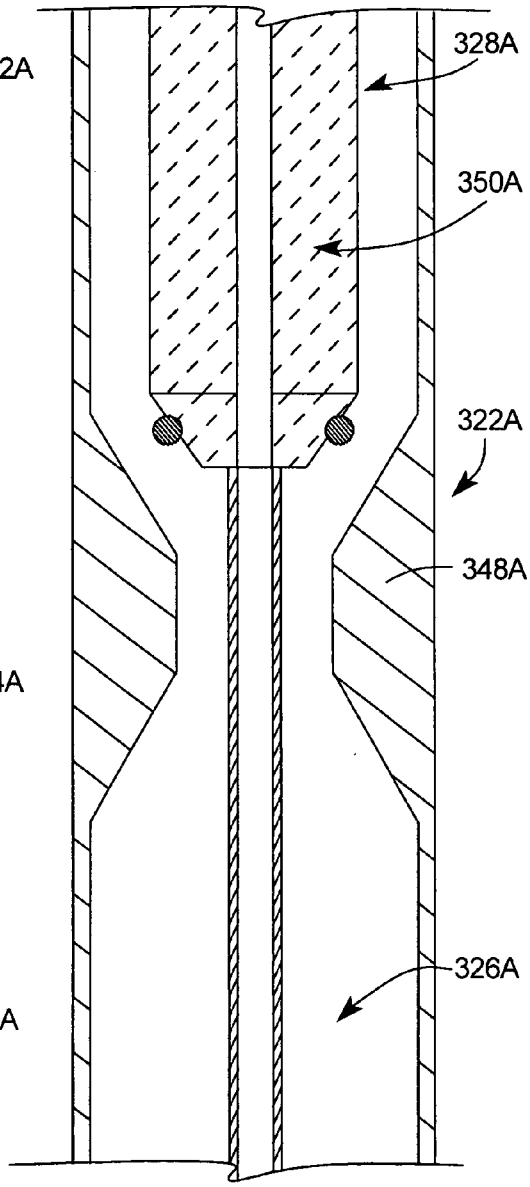
FIG. 3B is a cross-sectional view of the portion of the zone isolation assembly illustrated in FIG. 3A, shown in a disengaged position.

FIG. 3B is a cross-sectional view of the zone isolation assembly 322A illustrated in FIG. 3A, including the docking apparatus 350A shown in the disengaged position relative to the docking receiver 348A. In the disengaged position, any fluid that migrates into the first zone 326A through the fluid inlet structure 229 (illustrated in FIG. 2) can freely move into and mix with the second zone 328A to at least partially fill the riser pipe 230 (illustrated in FIG. 2). In other words, in the disengaged position, the first zone 326A and the second zone 328A are in fluid communication with one another.

Figure 3C:
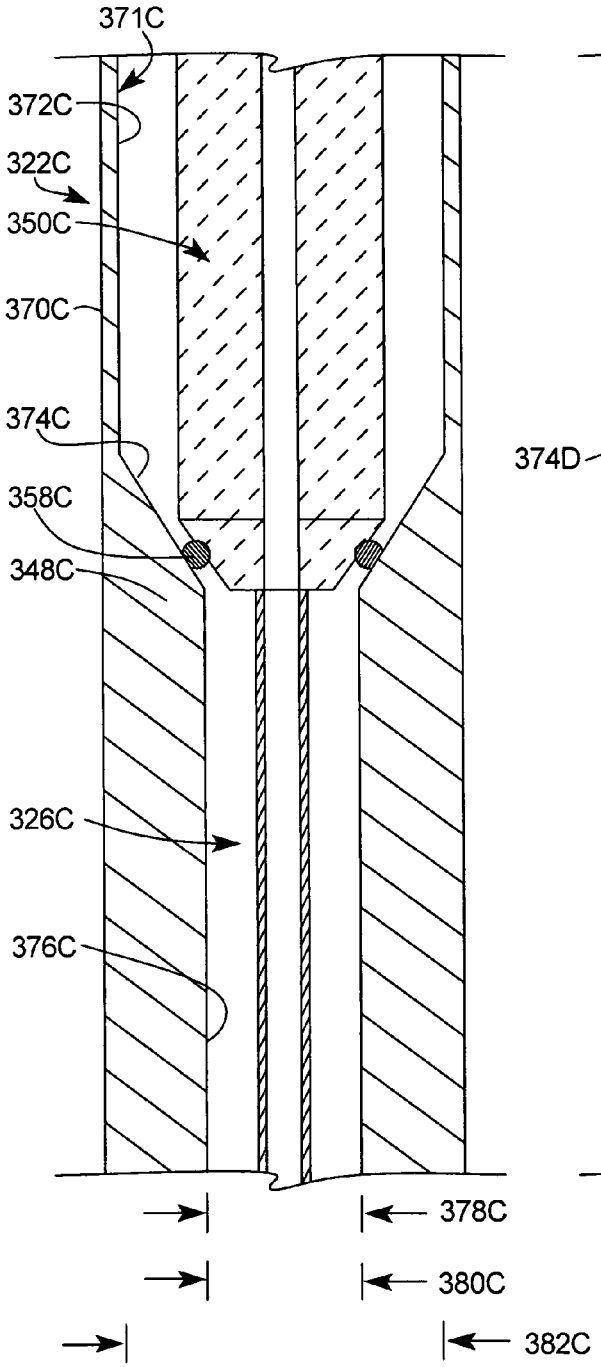
FIG. 3C is a cross-sectional view of a portion of an embodiment of the zone isolation assembly including a docking apparatus shown in an engaged position with a second embodiment of the docking receiver.

FIG. 3C is a cross-sectional view of a portion of another embodiment of the zone isolation assembly 322C including a docking apparatus 350C shown in the engaged position with a second embodiment of the docking receiver 348C. In this embodiment, the docking receiver 348C has an exterior surface 370C and an interior surface 371C having a substantially linear upper section 372C, a tapered intermediate section 374C and a substantially linear lower section 376C. In one embodiment, the upper section 372C of the interior surface 371C is substantially parallel with the exterior surface 370C.

The intermediate section 374C has an inner diameter 378C near the location of contact between the resilient seal 358C and the docking receiver 348C that is smaller than an inner diameter 382C of the upper section 372C. Further, the inner diameter 380C of the lower section 376C is somewhat reduced, and is substantially similar to the inner diameter 378C of the intermediate section 376C near the location of contact between the resilient seal 358C and the docking receiver 348C. In this embodiment, the lower section 376C of the interior surface 371C is substantially parallel with the exterior surface 370C. The reduced inner diameter 380C of the lower section 376C provides a smaller volume in the first zone 326C. Because the first zone 326C has a somewhat smaller volume, the volume of the first fluid to be purged from the first zone 326C is reduced, therefore decreasing the purge time prior to sampling the first zone 326C.

Figure 3D:
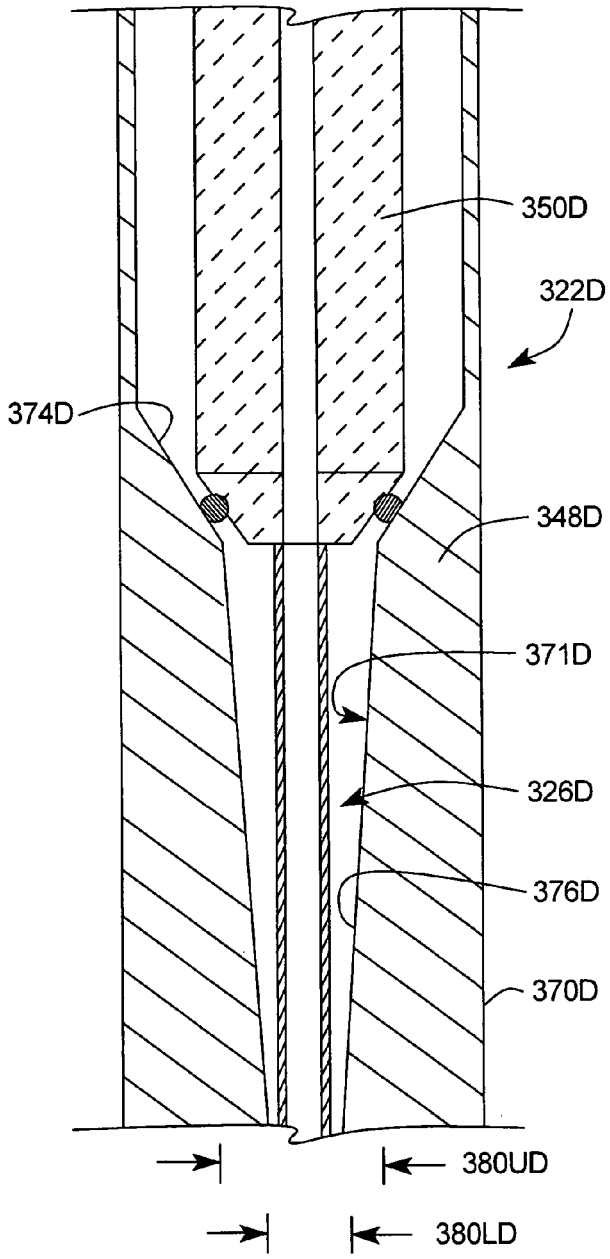
FIG. 3D is a cross-sectional view of a portion of an embodiment of the zone isolation assembly including a docking apparatus shown in an engaged position with a third embodiment of the docking receiver.

FIG. 3D is a cross-sectional view of a portion of another embodiment of the zone isolation assembly 322D including a docking apparatus 350D shown in the engaged position with a third embodiment of the docking receiver 348D. In this embodiment, the lower section 376D has an upper inner diameter 380UD that is greater than a lower inner diameter 380LD of the lower section 376D. Thus, the lower section 376D is tapered so that the inner diameter decreases in a direction from the intermediate section 374D toward the lower section 376D. The In other words, the interior surface 371D of the lower section 376D is non-parallel with the exterior surface 370D. With this design, the volume of the first zone 326D is further reduced. As a result of the reduced volume of the first zone 326D, the volume of groundwater to be purged from the first zone 326D is reduced even more, therefore decreasing the purge time prior to sampling the first zone 326D.

Figure 4:
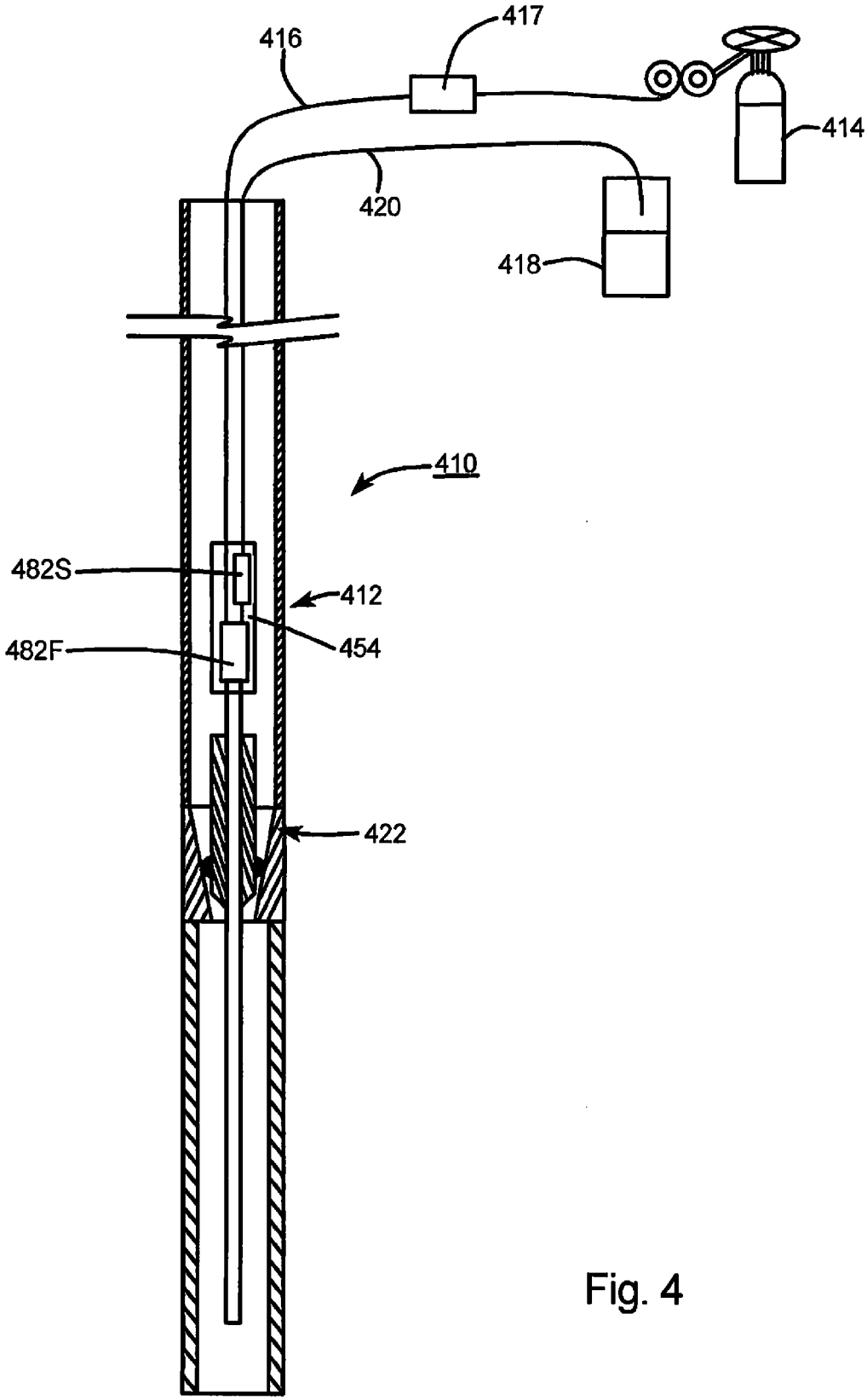
FIG. 4 is a schematic view of another embodiment of the fluid monitoring system.

FIG. 4 is a schematic view of another embodiment of the fluid monitoring system 410. In FIG. 4, the environment 11 (illustrated in FIG. 1) and the annular materials 24A-C (illustrated in FIG. 1) have been omitted for simplicity. In the embodiment illustrated in FIG. 4, the fluid monitoring system 410 includes components and structures that are somewhat similar to those previously described, including the subsurface well 412, the gas source 414, the gas inlet line 416, the controller 417, the fluid receiver 418, the fluid outlet line 420 and the zone isolation assembly 422. However, in this embodiment, the pump assembly 454, described in greater detail below, of the zone isolation assembly 422 includes two one-way valves including a first valve 482F and a second valve 482S. The pump assembly 454 provides one or more advantages over other types of pump assemblies as set forth herein.

Figure 5:
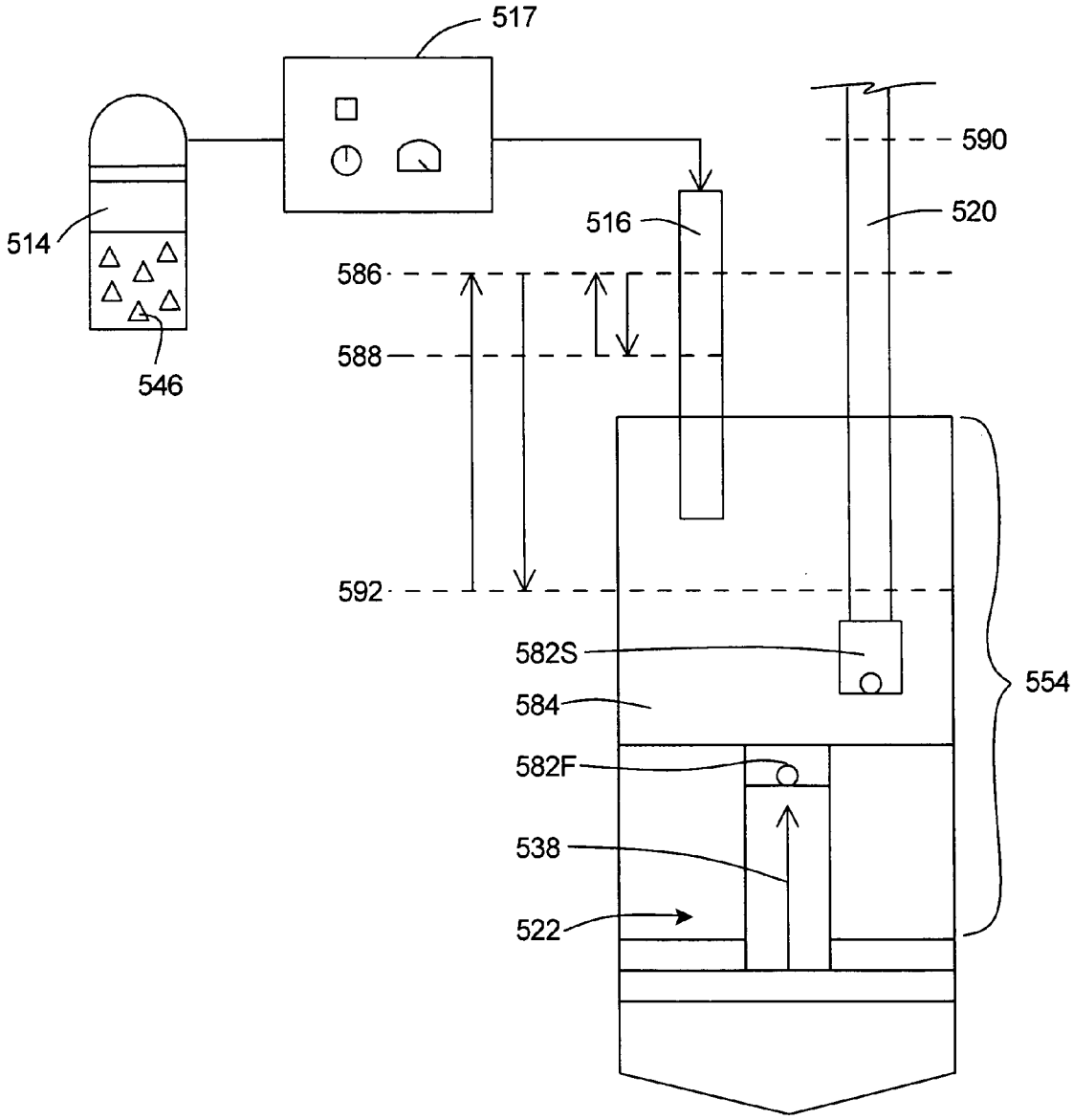
FIG. 5 is a schematic view of a portion of one embodiment of the fluid monitoring system including a pump assembly.

FIG. 5 is a schematic diagram of a portion of one embodiment of the fluid monitoring system 510 including a gas source 514, a gas inlet line 516, a controller 517, a fluid outlet line 520, a zone isolation assembly 522, and a pump assembly 554. The zone isolation assembly 522 functions in a substantially similar manner as previously described. More specifically, the first zone 26 (illustrated in FIG. 1) is isolated from the second zone 28 (illustrated in FIG. 1) so that the first fluid 538 can migrate or be drawn into the pump assembly 554.

The specific design of the pump assembly 554 can vary. In this embodiment, the pump assembly 554 is a two-valve, two-line assembly. The pump assembly 554 includes a pump chamber 584, a first valve 582F, a second valve 582S, a portion of the gas inlet line 516 and a portion of the fluid outlet line 520. The pump chamber 584 can encircle one or more of the valves 582F, 582S and/or portions of the lines 516, 520.

The first valve 582F is a one-way valve that allows the first fluid (represented by arrow 538) to migrate or otherwise be transported from the first zone 26 into the pump housing 584. For example, the first valve 582F can be a check valve or any other suitable type of one-way valve that is open as the well fluid level 42W (illustrated in FIG. 1) equilibrates with the environmental fluid level 42E (illustrated in FIG. 1). As the level of the first fluid 538 rises, the first valve 582F is open, allowing the first fluid 538 to pass through the first valve 582F and into the pump chamber 584. However, if the level of the first fluid 538 begins to recede, the first valve 582F closes and inhibits the first fluid 538 from moving back into the first zone 26.

The second valve 582S can also be a one-way valve that operates by opening to allow the first fluid 538 into the fluid outlet line 520 as the level of the first fluid 538 rises within the pump chamber 584 due to the equilibration process described previously. However, any back pressure in the fluid outlet line 520 causes the second valve 582S to close, thereby inhibiting the first fluid 538 from receding from the fluid outlet line 520 back into the pump chamber 584.

In certain embodiments, the first fluid 538 within the fluid outlet line 520 is systematically moved toward and into the fluid receiver 18 (illustrated in FIG. 1). In FIG. 5, two different embodiments for moving the first fluid 538 toward the fluid receiver 18 are illustrated. In the first embodiment, the first fluid 538 is allowed to equilibrate to an initial fluid level 586 in both the gas inlet line 516 and the fluid outlet line 520. The controller 517 (or an operator) then causes the gas 546 from the gas source 514 to move downward in the gas inlet line 516 to force the first fluid 538 to a second fluid level 588 in the gas inlet line 516. This force causes the first valve 582F to close, and because the first fluid 538 has nowhere else to move to, the first fluid 538 forces the second valve 582S to open to allow the first fluid 538 to move in an upwardly direction in the fluid outlet line 520 to a third fluid level 590 in the fluid outlet line 520.

The gas source 514 is then turned off to allow the level of the first fluid 538 in the gas inlet line 516 to equilibrate with the environmental fluid level 42E. The second valve 582S closes, inhibiting any change in the level of the first fluid 538 in the fluid outlet line 520. Once the first fluid 538 in the gas inlet line 516 has equilibrated with the environmental fluid level 42E, the process of opening the gas source 514 to move the gas 546 downward in the gas inlet line 516 is repeated. Each such cycle raises the level of the first fluid 538 in the fluid outlet line 520 until a desired amount of the first fluid 538 reaches the fluid receiver 18. The gas cycling in this embodiment can be utilized regardless of the time required for the first fluid 538 to equilibrate, but this embodiment is particularly suited toward a relatively slow equilibration processes.

In the second embodiment illustrated in FIG. 5, a greater volume of gas 546 is used following equilibration of the first fluid to the initial fluid level 586. Thus, in this embodiment, instead of maintaining the gas 546 within the gas inlet line 516 during each cycle, the gas source 514 is opened until the first fluid 538 is forced downward, out of the gas inlet line 516 and downward in the pump chamber 584 to a fourth fluid level 592 within the pump chamber 584. As provided previously, when the gas 546 is forced downward into the pump chamber 584, the first valve 582F closes and the second valve 582S opens. This allows the first fluid 538 to move upward in the fluid outlet line 520 to a greater extent during each cycle. The gas source 514 is then closed, the first fluid within the pump chamber 584 and the gas inlet line 516 equilibrates, and the cycle is repeated until the desired volume of first fluid 538 is delivered to the fluid receiver 18. The cycling in this embodiment can be utilized regardless of the time required for the first fluid 538 to equilibrate, but this embodiment is particularly suited toward a relatively rapid equilibration process.

With these designs, because the gas 546 is cycled up and down within the gas inlet line 516 and or pump chamber 584, and no pressurization of the riser pipe 30 (illustrated in FIG. 1) is required, only a small volume of gas 546 is consumed, and the gas 546 is thereby conserved. Further, in this embodiment, the gas 546 does not come into contact with the first fluid 538 in the fluid outlet line 520. Consequently, potential VOC loss caused by contact between the gas 546 and the first fluid 538 can be inhibited or eliminated.

Figure 6A:
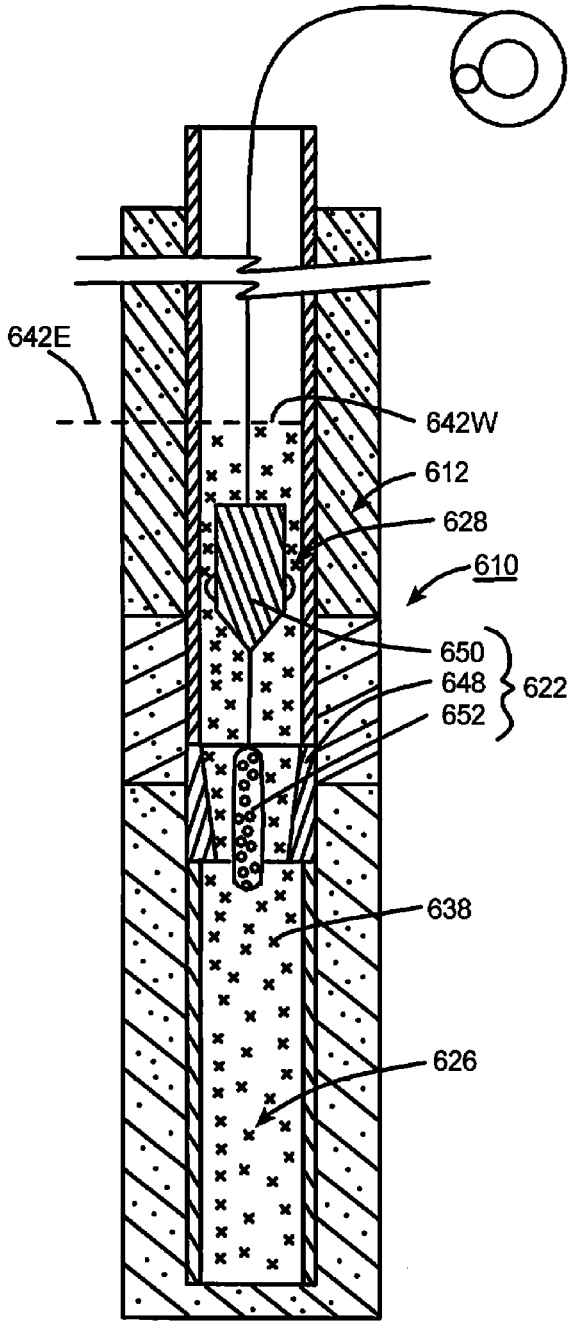
FIG. 6A is a schematic view of a portion of one embodiment of the fluid monitoring system including the zone isolation assembly with the docking apparatus illustrated in the disengaged position.
Figure 6B:
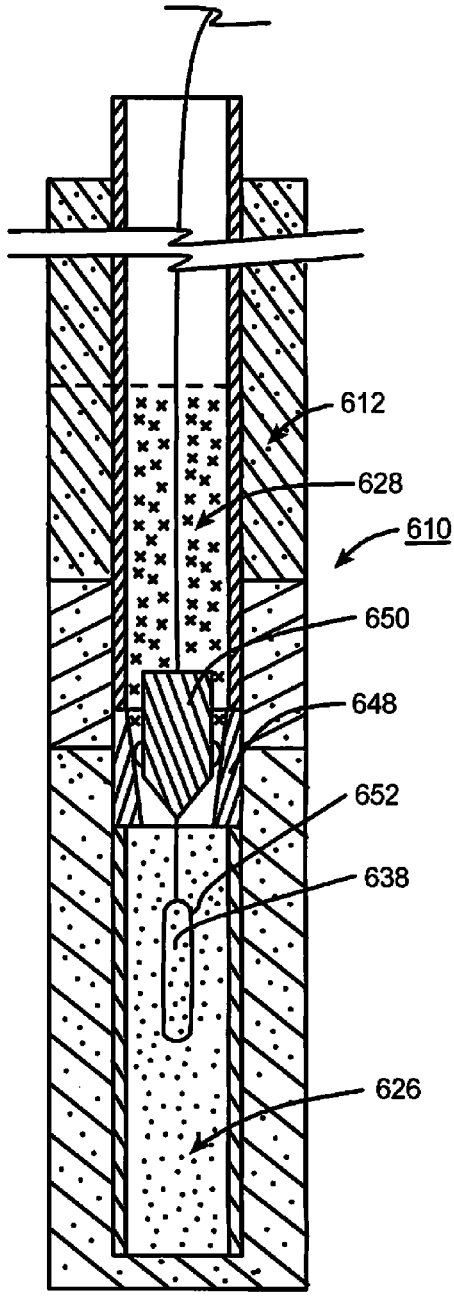
FIG. 6B is a schematic view of a portion of the fluid monitoring system illustrated in FIG. 6A, including the zone isolation assembly with the docking apparatus illustrated in the engaged position.

FIGS. 6A and 6B are schematic views of a portion of another embodiment of the fluid monitoring system 610 including the zone isolation assembly 622, illustrated in the disengaged position and the engaged position, respectively. In this embodiment, the zone isolation assembly 622 includes the docking receiver 648, the docking apparatus 650 and the fluid collector 652, which is coupled to the docking apparatus 650. Moreover, the docking apparatus 650 does not require a fluid channel 60 (illustrated in FIG. 1), as explained below. Further, in this embodiment, the pump assembly 54 (illustrated in FIG. 1) is unnecessary as described below.

In this embodiment, the fluid collector 652 is a passive diffusion sampler, such as a passive diffusion bag. In one embodiment, the passive diffusion sampler 652 can be formed from materials such as a low-density polyethylene lay-flat tubing bags that are filled with distilled and/or deionized water (indicated as O's in FIG. 6A) and then heat sealed at both ends. The passive diffusion sampler 652 is lowered into the first zone 626 of the well 612 where it is allowed to equilibrate with the first fluid 638 in the first zone 626.

Before the docking apparatus 650 is in the engaged position, the fluid (indicated by X's in FIG. 6A) in the well 612 can rise to the well fluid level 642W, in equilibrium with the environmental fluid level 642E. It is recognized that in a relatively tall column of fluid such as in the well 612, the composition of the fluid in the first zone 626 will likely be different than that in the second zone 628. Once the docking apparatus 650 is in the engaged position, over time the first fluid 638 in the first zone 626 will change as fluid from the environment 11 continues to equilibrate with the fluid in the first zone 626.

The passive diffusion sampler 652 is allowed a predetermined time period (approximately 2 weeks in one non-exclusive example) within the isolated first zone 626 to equilibrate with the first fluid 638 in the first zone 626. With this design, isolation of the passive diffusion sampler 652 within the first zone 626 reduces or eliminates diffusion-based averaging effects from the second zone 628 on VOC concentrations. Additionally, passive diffusion bags are relatively inexpensive in comparison to pump assemblies and other pumping devices. Because a pump assembly is not necessary for use with passive diffusion samplers 652, the cost of this type of system is reduced.

After the predetermined time period, the passive diffusion sampler 652 is removed from the well 612. The first fluid 638 (indicated as dots in FIG. 6B) in the passive diffusion sampler 652 is then analyzed as needed.

Figure 7A:
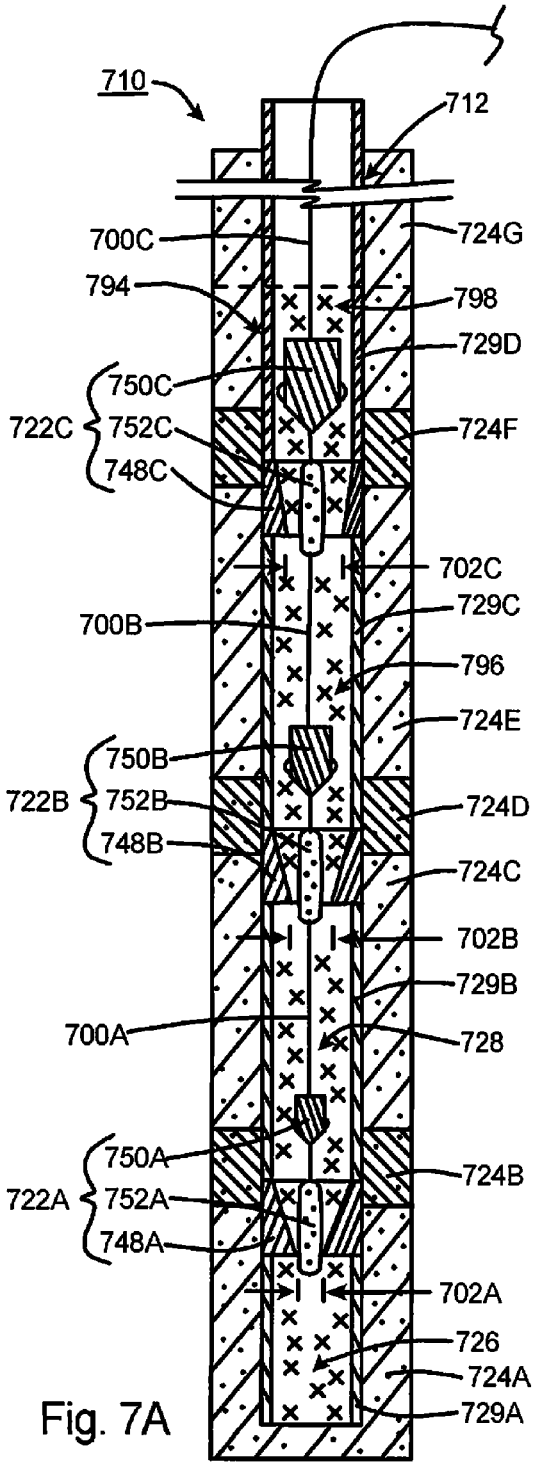
FIG. 7A is a schematic view of a portion of one embodiment of the fluid monitoring system including a zone isolation assembly array with the docking apparatuses illustrated in the disengaged position.
Figure 7B:
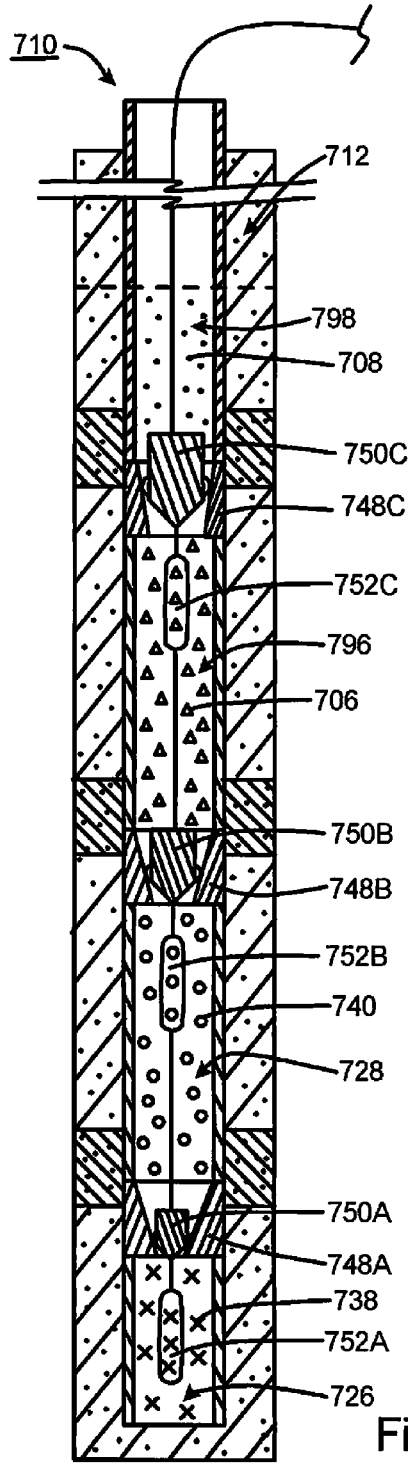
FIG. 7B is a is a schematic view of a portion of the fluid monitoring system illustrated in FIG. 7A, including the zone isolation assembly array with the docking apparatuses illustrated in the engaged position.

FIGS. 7A and 7B are views of a portion of another embodiment of the fluid monitoring system 710 including a zone isolation assembly array 794 illustrated in the disengaged position and the engaged position, respectively. The zone isolation assembly array 794 isolates a plurality of zones from one another so that multiple fluid samples can be retrieved from the well 712 for testing. The design of the zone isolation assembly array 794 can be varied to suit the design requirements of the fluid monitoring system 710 and/or the subsurface well 712.

In this embodiment, the zone isolation assembly array 794 includes a plurality of zone isolation assemblies including a first zone isolation assembly 722A, a second zone isolation assembly 722B and a third zone isolation assembly 722C that are arranged in an in-line manner (also sometimes referred to as being arranged "in series") within a single subsurface well 712. It is recognized that although three zone isolation assemblies 722A-C are illustrated in FIG. 7A, any suitable number of zone isolation assemblies can be included in the zone isolation assembly array 794, depending upon the number of zones to be isolated.

Additionally, in the embodiment illustrated in FIGS. 7A and 7B, the zone isolation assembly array 794 includes a first connecting line 700A, a second connecting line 700B and an upper connecting line 700C. The first connecting line 700A connects components of the first zone isolation assembly 722A with components of the second zone isolation assembly 722B. More specifically, the first connecting line 700A connects the first docking apparatus 750A with the second fluid collector 752B. Somewhat similarly, the second connecting line connects components of the second zone isolation assembly 722B with components of the third zone isolation assembly 722C. More specifically, the second connecting line 700B connects the second docking apparatus 750B with the third fluid collector 752C. The upper connecting line 700C connects to the third docking apparatus 750C and continues to the surface region 732 where the upper connecting line exits the well 712. The third connecting line 700C can be used to raise and/or lower the docking apparatuses 750A-C and the fluid collectors 752A-C.

In one embodiment, each zone isolation assembly 722A-C is designed to selectively isolate two adjacent zones from one another in a somewhat similar manner to that previously described herein. In the embodiment illustrated in FIGS. 7A and 7B, the well 712 includes a first zone 726, a second zone 728, a third zone 796 and a fourth zone 798. Further, the subsurface well 712 can include one or more layers of annular materials, as previously described herein. For example, in the embodiment illustrated in FIG. 7A, the well 712 can include a first layer 724A, a second layer 724B, a third layer 724C, a fourth layer 724D, a fifth layer 724E, a sixth layer 724F and a seventh layer 724G. The number of layers 724A-G can depend upon the number of zone isolation assemblies 722A-C included in the zone isolation assembly array 794. The layers 724A-G can alternate between a relatively permeable layer such as sand, and a relatively impermeable layer such as bentonite, in one non-exclusive example.

In one embodiment, each relatively permeable layer is positioned adjacent to one of the fluid inlet structures 729A-D. For example, the first layer 724A is positioned adjacent to the first fluid inlet structure 729A. In this embodiment, fluid can move through the first layer 724A and through the fluid inlet structure 729A into the first zone 726. Somewhat similarly, fluid can move through the third layer 724C and the second fluid inlet structure 729B into the second zone, fluid can move through the fifth layer 724E and the third inlet structure 729C into the third zone 796, and fluid can move through the seventh layer 724G and the fourth inlet structure 729D into the fourth zone 798.

In this embodiment, the first zone isolation assembly 722A can selectively isolate the first zone 726 from the second zone 728. The second zone isolation assembly 722B can selectively isolate the second zone 728 from the third zone 796. The third zone isolation assembly 722C can selectively isolate the third zone 796 from the fourth zone 798. As used herein, when two zones are said to be isolated from one another, fluid communication is inhibited between the two zones. When two zones are not isolated from one another, the two zones are in fluid communication with one another.

In the embodiment illustrated in FIGS. 7A and 7B, these zones 726, 728, 796, 798 can be isolated in a concerted manner so that either all zones 726, 728, 796, 798 are isolated from each other adjacent zone or none of the zones 726, 728, 796, 798 are isolated from one another, e.g., all zones 726, 728, 796, 798 are in fluid communication with one another.

Alternatively, certain zones can be isolated from one another, while other zones are not isolated from one another, as explained in greater detail below.

In the embodiment illustrated in FIGS. 7A and 7B, the first zone isolation assembly 722A includes a first docking receiver 748A, a first docking apparatus 750A and a first fluid collector 752A. The second zone isolation assembly 722B includes a second docking receiver 748B, a second docking apparatus 750B and a second fluid collector 752B. The third zone isolation assembly 722C includes a third docking receiver 748C, a third docking apparatus 750C and a third fluid collector 752C. In an alternative embodiment, each zone isolation assembly 722A-C can have greater than one fluid collector 752A-C. In an alternative embodiment, one or more of the zone isolation assemblies 722A-C can omit the corresponding fluid collector 752A-C.

In one embodiment, the fluid collectors 752A-C are all passive diffusion samplers, such as passive diffusion bags described previously herein. In non-exclusive alternative embodiments, one or more of the fluid collectors 752A-C can be any other suitable type of fluid collector 752A-C, such as a pressurized or unpressurized bailer, a sipping tube, a sensor for sensing various fluid properties in the fluid, or any other fluid collector 752A-C known to those skilled in the art.

In this embodiment, various components of each zone isolation assembly 722A-C can have a different size from like components of the remaining zone isolation assemblies. In one embodiment, the first docking apparatus 750A is smaller than the second docking apparatus 750B and the third docking apparatus 750C. Somewhat similarly, the second docking apparatus 750B is smaller than the third docking apparatus 750C. In one embodiment, the fluid collectors 752A-C can all have the same size. Alternatively, the fluid collectors 752A-C can have different sizes from one another.

Additionally, each docking receiver 748A-C has a different sized lower receiver opening 702A-C. In the embodiment illustrated in FIGS. 7A and 7B, the first docking receiver 748A has a first lower receiver opening 702A that is smaller than both a second lower receiver opening 702B of the second docking receiver 748B and a third lower receiver opening 702C of the third docking receiver 748C. Further, the second lower receiver opening 702B is smaller than the third lower receiver opening 702C. This disparity in lower receiver openings 702A-C allows certain smaller components to move in a downwardly direction in the well 712, while other larger components are inhibited from moving down the well 712.

Further, in certain embodiments, the docking apparatuses 750A-C and the fluid collectors 752A-C are all connected together in an alternating in-line manner (in series), as illustrated in FIGS. 7A and 7B. Because of the disparate sizing of the zone isolation assemblies 722A-C, the first docking apparatus 750A and the first fluid collector 752A can be lowered (or raised during removal) down through the third lower receiver opening 702C of the third docking receiver 748C and the second lower receiver opening 702B of the second docking receiver 748B, as illustrated in FIG. 7A. Further, the second docking apparatus 750B and the second fluid collector 752B can be lowered (or raised during removal) down through the third lower receiver opening 702C of the third docking receiver 748C, as illustrated in FIG. 7A.

In a somewhat similar manner to that previously described herein, the first docking apparatus 750A moves into the engaged position with the first docking receiver 748A. When in the engaged position, as illustrated in FIG. 7B, the first fluid collector 752A is positioned in the first zone 726, and the first zone 726 is isolated from the second zone 728. In one embodiment, all of the docking apparatuses 750A-C move to the engaged position with their respective docking receivers 748A-C in a synchronized manner. For example, the docking apparatuses 750A-C can move from the disengaged position to the engaged position with their respective docking receivers 748A-C at substantially the same time, as illustrated in FIG. 7B, for example. Further, the docking apparatuses 750A-C can move from the engaged position to the disengaged position in a synchronized manner, such as at substantially the same time, for example.

Once the docking apparatuses 750A-C are in the engaged position relative to the docking receivers 748A-C, the four zones 726, 728, 796, 798 are isolated from one another. In the embodiment illustrated in FIG. 7B, the fluid collectors 752A-C can collect fluid over any suitable period of time, such as 2-3 weeks, from their respective zone 726, 728, 796. More specifically, the first fluid collector 752A can collect a first fluid 738 from the first zone 726, the second fluid collector 752B can collect a second fluid 740 from the second zone 728, and the third fluid collector 752C can collect a third fluid 706 from the third zone 796. Once the passive diffusion bags 752A-C have equilibrated, the entire series of docking apparatuses 750A-C and fluid collectors 752A-C can be removed from the well 712. Because of the relatively slow rate of diffusion of the passive diffusion bags, little or no dilution with fluids from other zones occurs during the removal process.

Figure 8A:
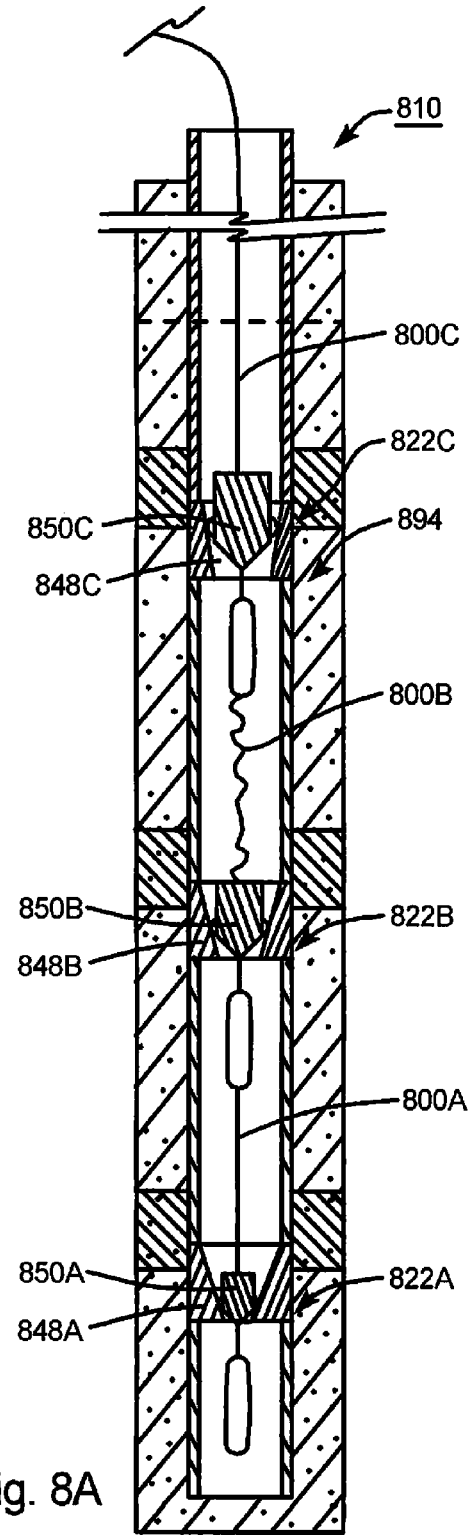
FIG. 8A is a schematic view of another embodiment of a portion of the fluid monitoring system, including the zone isolation assembly array with the docking apparatuses illustrated in the engaged position.
Figure 8B:
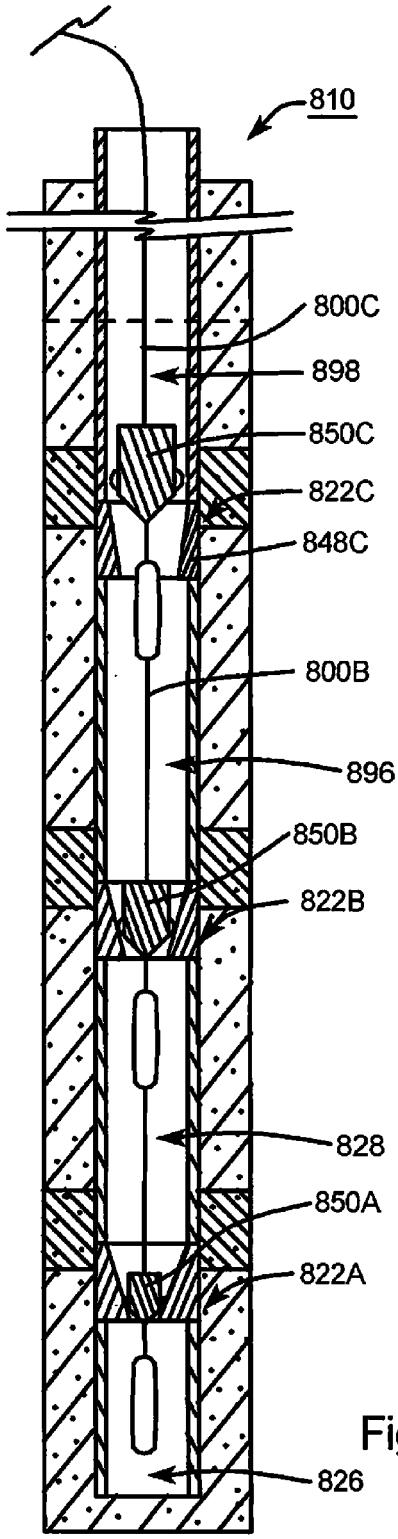
FIG. 8B is a is a schematic view of the portion of the fluid monitoring system illustrated in FIG. 8A, including the zone isolation assembly array with a first docking apparatus and a second docking apparatus illustrated in the engaged position and a third docking apparatus illustrated in the disengaged position.

FIGS. 8A and 8B are views of a portion of another embodiment of the fluid monitoring system 810 including a zone isolation assembly array 894 illustrated in an engaged position and a partially disengaged position, respectively. In this embodiment, certain zones can be isolated from one another, while fluid communication is permitted between other zones. This type of "zone-selective" isolation can be accomplished by altering the length of one or more of the connecting lines 800A-B between the zone isolation assemblies 822A-C, and adjusting and/or maintaining a particular tension on the upper connecting line so that certain docking apparatuses are in the engaged position, while other docking apparatuses are in the disengaged position.

As illustrated in FIG. 8A, the tension on the upper connecting line 800C has been released at least until all docking apparatuses 850A-C have reached the engaged position relative to the docking receivers 848A-C. In this embodiment, in the engaged position, the second connecting line 800B is slackened somewhat. It is recognized that other connecting lines, e.g., the first connecting line 800A, can also be slackened when the second docking apparatus 850B is in the engaged position. However, for purposes of this example, the first connecting line 800A is essentially taut.

As illustrated in FIG. 8B, when the upper connecting line 800C is pulled in an upwardly direction, because of the slack in the second connecting line 800B, the third docking apparatus 850C moves to the disengaged position relative to the third docking receiver 848C before any other docking apparatus 850A-B moves to the disengaged position. The slack in the second connecting line 800B is taken up during the upward movement of the upper connecting line 800C. Therefore, in FIG. 8B, the first zone 826 remains substantially isolated from the second zone 828, and the second zone remains substantially isolated from the third zone 896. However, the third zone 896 is now in fluid communication with the fourth zone 898.

It is understood that various permutations of this embodiment can achieve different results by lengthening and/or shortening the connecting lines 800A-B, depending upon the number of zone isolation assemblies 822A-C and zones 826, 828, 896, 898 that are present within a given fluid monitoring system 810. For example, by slackening the first connecting line 800A in addition to slackening the second connecting line 800B, during removal and/or placement of the docking apparatuses 850A-C the zone isolation assemblies 822A-C can be sequentially moved between the disengaged position and the engaged position, rather than in a synchronized manner. With this design, the fluid monitoring system 810 can test, monitor and/or analyze fluid, or sense fluid properties, from individual zones as well as from combinations of adjacent zones simultaneously.

Figure 9:
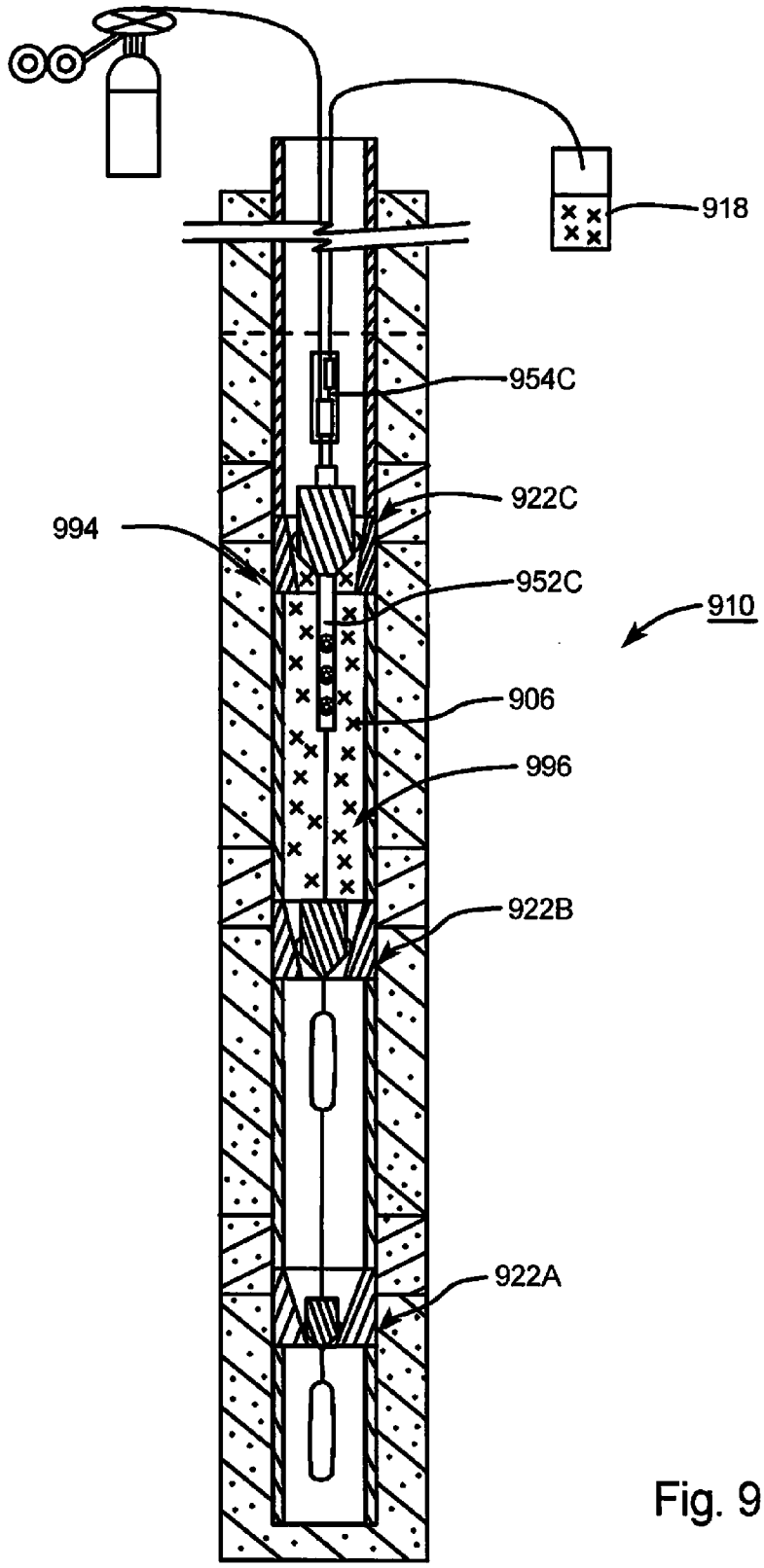
FIG. 9 is a schematic view of yet another embodiment of a portion of the fluid monitoring system, including the zone isolation assembly array with the docking apparatuses illustrated in the engaged position.

FIG. 9 is a schematic view of still another embodiment of a portion of the fluid monitoring system 910 including the zone isolation assembly array 994. The zone isolation assembly array 994 includes the first zone isolation assembly 922A, the second zone isolation assembly 922B and the third zone isolation assembly 922C, each of which are illustrated in an engaged position. In this embodiment, the zone isolation assemblies 922A-C can differ from one another in function in addition to size and positioning.

For example, in the embodiment illustrated in FIG. 9, the first zone isolation assembly 922A and the second zone isolation assembly 922B can be somewhat similar to those described in previous embodiments. However, in this embodiment, one of the zone isolation assemblies (in this case, the third zone isolation assembly 922C) can include a different type of fluid collector 952C, as well as a pump assembly 954C. For example, the fluid collector 952C can be a sipping tube that collects the third fluid 906 from the third zone 996 in a somewhat similar manner as that previously described. The third fluid 906 can then be pumped using the pump assembly 954 to a fluid receiver 918 in a manner previously described herein. In non-exclusive alternative embodiments, one or more of the zone isolation assemblies can include other types of fluid collectors described herein and/or known to those skilled in the art.

Figure 10:
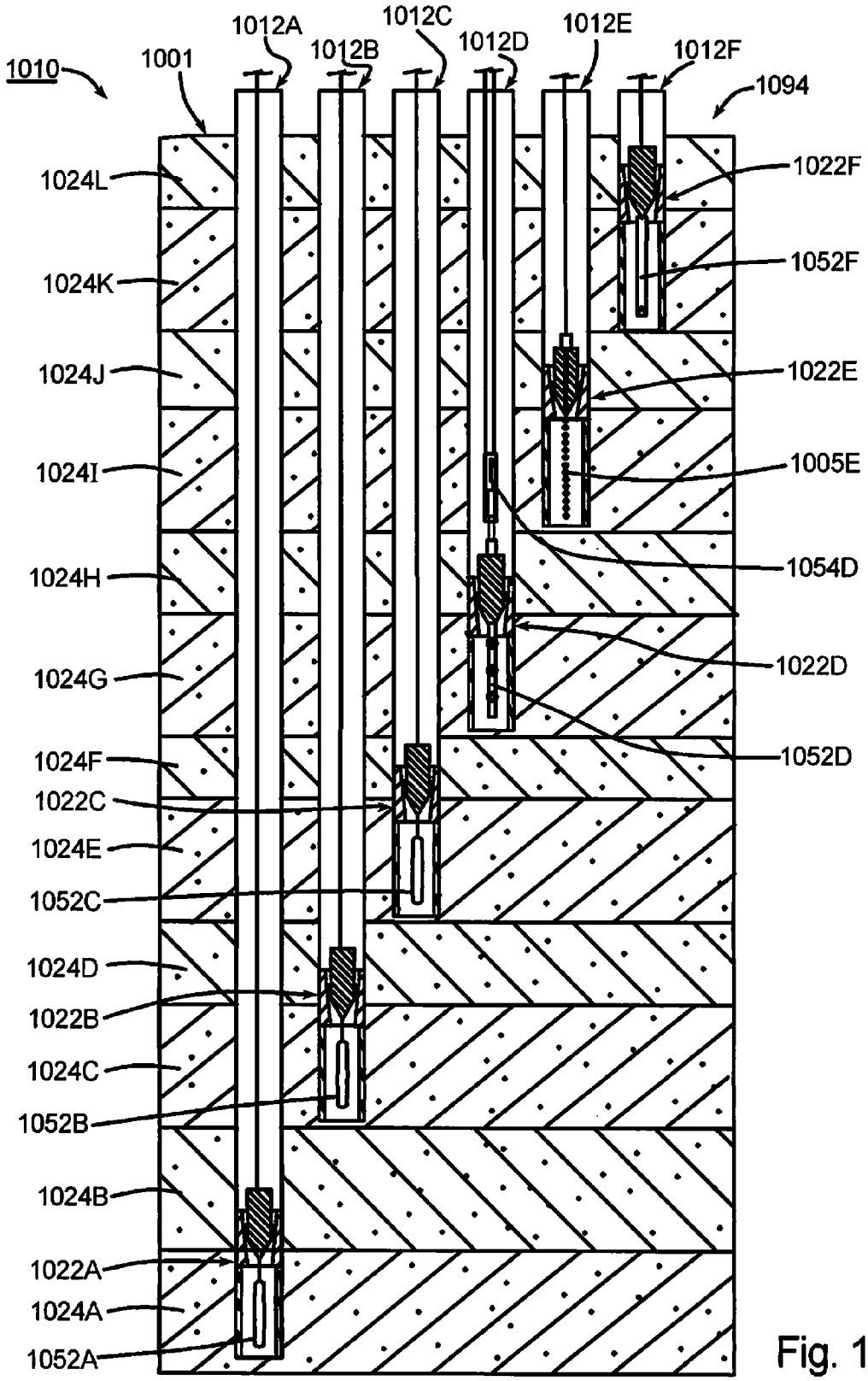
FIG. 10 is a schematic view of still another embodiment of a portion of the fluid monitoring system, including the zone isolation assembly array with the docking apparatuses illustrated in the engaged position.

FIG. 10 is a schematic view of another embodiment of a portion of the fluid monitoring system 1010 including the zone isolation assembly array 1094. In this embodiment, the zone isolation assembly array 1094 includes a plurality of wells 1012A-F within a single borehole 1001. With this design, the fluid from a plurality of different zones is monitored, tested, sensed and/or analyzed.

In the embodiment illustrated in FIG. 10, the borehole 1001 includes a plurality of layers of annular materials 1024A-L, and six wells 1012A-F. The layers of annular materials 1024A-L can alternate between a relatively permeable layer such as sand, and a relatively impermeable layer such as bentonite, in one non-exclusive example.

Each well 1012A-F includes a corresponding zone isolation assembly 1022A-F. It is understood that although the wells 1012A-F are illustrated as being in a line within the borehole 1001, this is provided for ease of illustration, and that any suitable arrangement of the wells 1012A-F within the borehole can be utilized. As one non-exclusive alternative example, the wells 1012A-F can be arranged in a circular manner.

In certain embodiments, the zone isolation assembly array 1094 is arranged so that each zone isolation assembly 1022A-F is positioned at a different depth within the borehole 1001. With this design, fluids (gases or liquids) from different depths can be analyzed or treated. In one embodiment, a plurality of zone isolation assemblies 1022A-C can be substantially similar to one another. For example, each zone isolation assembly 1022A-C can include the same type of fluid collector 1052A-C, such as a passive diffusion sampler.

Further, other zone isolation assemblies 1022D-F can include different components than those included in zone isolation assemblies 1022A-C. For example, in the embodiment illustrated in FIG. 10, the fluid collector 1052D in zone isolation assembly 1022D includes a sipping tube. Further, zone isolation assembly 1022D includes a pump assembly 1054D.

In this embodiment, zone isolation assembly 1022E includes a fluid property sensor 1005E such as a Fiber Bragg Grating sensor or any other suitable type of fluid property sensor. The fluid property sensor 1005E can sense one or more fluid properties, including electrical properties, optical properties, acoustical properties, chemical properties and/or hydraulic properties. Further, zone isolation assembly 1022F includes fluid collector 1052F, which is a pressurized bailer, for example. It is recognized that the specific types of zone isolation assemblies 1022A-F can vary depending upon the design requirements of the fluid monitoring system 1010.

In another embodiment, one or more of the wells 1012A-F can include a zone isolation assembly array previously described, which can include a plurality of zone isolation assemblies.

It is recognized that the various embodiments illustrated and described herein are representative of various combinations of features that can be included in the fluid monitoring system 10 and the zone isolation assemblies 22. However, numerous other embodiments have not been illustrated and described as it would be impractical to provide all such possible embodiments herein. It is to be understood that an embodiment of the zone isolation assembly 22 can include any of the docking receivers 48, docking apparatuses 50, fluid collectors 52, pump assemblies 54, and any of the other structures described herein depending upon the design requirements of the fluid monitoring system 10 and/or the subsurface well 12, and that no limitations are intended by not specifically illustrating and describing any particular embodiment.

While the particular fluid monitoring systems 10 and zone isolation assembly arrays 794 as herein shown and disclosed in detail are fully capable of obtaining the objects and providing the advantages herein before stated, it is to be understood that they are merely illustrative of various embodiments of the invention. No limitations are intended to the details of construction or design herein shown other than as described in the appended claims.

What is claimed is:

1. A zone isolation assembly array for a subsurface well, the subsurface well including a surface region, a first zone, a second zone and a third zone, each zone being positioned at a different depth from one another below the surface region, the zone isolation assembly array comprising:

a first docking receiver that is fixed within the subsurface well;

a second docking receiver that is fixed within the subsurface well, the second docking receiver being positioned more proximate the surface region than the first docking receiver;

a first docking apparatus that is adapted to be moved from the surface region to an engaged position with the first docking receiver to inhibit fluid communication between the first zone and the second zone; and a second docking apparatus that is coupled to the first docking apparatus, the second docking apparatus being adapted to be moved from the surface region to an engaged position with the second docking receiver to inhibit fluid communication between the second zone and the third zone, the second docking apparatus moving away from the engaged position at a different time than the first docking apparatus moves away from the engaged position.

2. The zone isolation assembly array of claim 1 wherein the first docking receiver has a shape that is different than a shape of the second docking receiver.

3. The zone isolation assembly array of claim 1 wherein the first docking apparatus and the second docking apparatus are different sizes from one another.

4. The zone isolation assembly array of claim 1 wherein the second docking receiver has a second lower receiver opening, and the first docking apparatus is adapted to move through the second lower receiver opening during movement of the first docking apparatus from the surface region to engagement with the first docking receiver.

5. The zone isolation assembly array of claim 1 wherein the first docking receiver and the second docking receiver are positioned in an in-line manner within the subsurface well.

6. The zone isolation assembly array of claim 1 further comprising a first fluid collector that is coupled to the first docking apparatus, the first fluid collector being adapted to collect a first fluid from within the first zone when the first docking apparatus is in the engaged position with the first docking receiver.

7. The zone isolation assembly array of claim 6 further comprising a second fluid collector that is coupled to the second docking apparatus, the second fluid collector being adapted to collect a second fluid from within the second zone when the second docking apparatus is in the engaged position with the second docking receiver.

8. The zone isolation assembly array of claim 7 wherein the first fluid collector collects the first fluid in a different manner than the second fluid collector collects the second fluid.

9. The zone isolation assembly array of claim 7 wherein the first fluid collector collects the first fluid in substantially the same manner as the second fluid collector collects the second fluid.

10. The zone isolation assembly array of claim 7 wherein the first fluid collector collects the first fluid simultaneously with the second fluid collector collecting the second fluid.

11. The zone isolation assembly array of claim 1 wherein the first docking receiver includes a first lower receiver opening positioned within the first zone, and the second docking receiver includes a second lower receiver opening positioned within the second zone, the second lower receiver opening being larger than the first lower receiver opening.

12. The zone isolation assembly array of claim 11 wherein the first zone isolation assembly includes a first fluid collector that is coupled to the first docking apparatus, the first fluid collector moving through the second lower receiver opening when the first docking apparatus moves from the surface region to the engaged position.

13. The zone isolation assembly array of claim 1 wherein at least one of the docking apparatuses is maintained in the engaged position substantially by a force of gravity.

14. A zone isolation assembly array for a subsurface well having a surface region, the subsurface well including a first zone, a second zone and a third zone, each zone being positioned at a different depth from one another within the subsurface well relative to the surface region, the zone isolation assembly array comprising:

a first zone isolation assembly that moves between a disengaged position that allows fluid communication between the first zone and the second zone and an engaged position that inhibits fluid communication between the first zone and the second zone, the first zone isolation assembly including a first docking apparatus and a first docking receiver that receives the first docking apparatus into the engaged position; and a second zone isolation assembly that is positioned between the first zone isolation assembly and the surface region, the second zone isolation assembly moving between a disengaged position that allows fluid communication between the second zone and the third zone and an engaged position that inhibits fluid communication between the second zone and the third zone, the second zone isolation assembly including a second docking apparatus and a second docking receiver that receives the second docking apparatus into the engaged position;

wherein the first docking apparatus and the second docking apparatus are coupled to one another, and wherein the first zone isolation assembly and the second zone isolation assembly each necessarily move from the engaged position to the disengaged position at different times.

15. The zone isolation assembly array of claim 14 wherein the first zone isolation assembly includes a first lower receiver opening positioned within the first zone, and the second zone isolation assembly includes a second lower receiver opening positioned within the second zone, the second lower receiver opening being larger than the first lower receiver opening.

16. The zone isolation assembly array of claim 15 wherein a portion of the first zone isolation assembly moves through the second lower receiver opening.

17. The zone isolation assembly array of claim 16 wherein the first docking apparatus moves through the second lower receiver opening when the first docking apparatus moves from the surface region to the engaged position.

18. The zone isolation assembly array of claim 17 wherein the first zone isolation assembly includes a first fluid collector that is coupled to the first docking apparatus, the first fluid collector moving through the second lower receiver opening when the first docking apparatus moves from the surface region to the engaged position.

19. The zone isolation assembly array of claim 14 wherein the first zone isolation assembly and the second isolation assembly are dissimilar from one another.

20. The zone isolation assembly array of claim 14 wherein the first zone isolation assembly and the second isolation assembly are dissimilar in size.

21. The zone isolation assembly array of claim 14 wherein the first zone isolation assembly and the second isolation assembly have a different configuration from one another.

22. The zone isolation assembly array of claim 14 wherein the first zone isolation assembly and the second isolation assembly are positioned in an in-line manner within the subsurface well.

23. The zone isolation assembly array of claim 14 further comprising a third zone isolation assembly that is positioned between the second zone isolation assembly and the surface region, the third zone isolation assembly moving between a disengaged position that allows fluid communication between the third zone and a fourth zone of the subsurface well and an engaged position that inhibits fluid communication between the third zone and the fourth zone.

24. The zone isolation assembly array of claim 14 wherein the first zone isolation assembly includes a first fluid collector that collects fluid from the first zone and the second zone isolation assembly includes a second fluid collector that collects fluid from the second zone when the zone isolation assemblies are each in the engaged position.

25. The zone isolation assembly array of claim 24 wherein the first fluid collector collects the first fluid in a different manner than the second fluid collector collects the second fluid.

26. The zone isolation assembly array of claim 24 wherein the first fluid collector collects the first fluid in substantially the same manner as the second fluid collector collects the second fluid.

27. The zone isolation assembly array of claim 24 wherein the first fluid collector collects the first fluid simultaneously with the second fluid collector collecting the second fluid.

28. The zone isolation assembly array of claim 14 wherein at least one of the zone isolation assemblies is maintained in the engaged position substantially by a force of gravity.

29. A method for isolating a plurality of zones within a subsurface well, the method comprising the steps of:

positioning at different depths from one another within the subsurface well (i) a first zone isolation assembly having a portion that selectively moves from a disengaged position to an engaged position that inhibits fluid communication between a first zone and a second zone within the subsurface well, and (ii) a second zone isolation assembly having a portion that selectively moves from a disengaged position to an engaged position that inhibits fluid communication between the second zone and a third zone within the subsurface well;

connecting the portion of the first zone isolation assembly with the portion of the second zone isolation assembly; and moving the portion of the second zone isolation assembly from the engaged position to the disengaged position without moving the portion of the first zone isolation assembly from the engaged position to the disengaged position.

30. The method of claim 29 wherein the step of positioning includes the first zone isolation assembly having a different configuration than the second zone isolation assembly.

31. The method of claim 29 further comprising the steps of collecting a first fluid from the first zone with a first fluid collector of the first zone isolation assembly when the portion of the first zone isolation assembly is in the engaged position, and collecting a second fluid from the second zone with a second fluid collector of the second zone isolation assembly when the portion of the second zone isolation assembly is in the engaged position.

32. The method of claim 29 wherein the step of positioning includes positioning the first zone isolation and the second zone isolation assembly in an in-line manner within the subsurface well.

33. The method of claim 29 further comprising the step of moving the portion of the first zone isolation assembly through part of the second zone isolation assembly while moving the portion of the first zone isolation assembly between a surface region and the engaged position.

* * * * *